US005754152A

United States Patent [19]

Nakamura et al.

[11] Patent Number: 5,754,152

[45] Date of Patent: May 19, 1998

[54] DRIVE METHOD AND DRIVE UNIT FOR A LIQUID CRYSTAL DISPLAY DEVICE REDUCING VARIATION OF APPLIED VOLTAGE DEPENDENT UPON DISPLAY PATTERNS

[75] Inventors: Toshihiro Nakamura, Tenri; Shunichi Murahashi, Nabari, both of Japan

[73] Assignee: Sharp Kabushiki Kaisha, Osaka, Japan

[21] Appl. No.: 565,278

[22] Filed: Nov. 30, 1995

[30] Foreign Application Priority Data

Feb. 16, 1995 [JP] Japan ..... 7-028346
May 26, 1995 [JP] Japan ..... 7-128008

[51] Int. Cl.[6] ..... G09G 3/36

[52] U.S. Cl. ..... 345/94; 345/53; 345/58; 345/97; 345/98

[58] Field of Search ..... 345/53, 58, 94, 345/97, 98

[56] References Cited

U.S. PATENT DOCUMENTS 5,296,877 3/1994 Takeda et al. ..... 345/58 X
5,398,043 3/1995 Takeda et al. ..... 345/94
5,442,370 8/1995 Yamazaki et al. ..... 345/94
5,561,442 10/1996 Okada et al. ..... 345/94
5,602,560 2/1997 Ikeda ..... 345/94
5,619,221 4/1997 Hirai et al. ..... 345/58

FOREIGN PATENT DOCUMENTS 289 1/1990 Japan .
3130797 6/1991 Japan .
5265402 10/1993 Japan .

*Primary Examiner*—Raymond J. Bayerl
*Assistant Examiner*—Seth D. Vail

[57] ABSTRACT

A drive method and a drive unit for a liquid crystal display unit which reduce the variation in the effective value of an applied voltage dependent upon the display patterns, are inexpensive, and enhance the display quality are provided. There is provided a segment-side liquid crystal drive circuit 2 which incorporates an output control section 26 where an output correction period is provided in an output of the segment-side liquid crystal drive circuit 2 at intervals of a 1-line scanning period, and during the output correction period a display voltage level of the output is set to an OFF display voltage level when the display voltage level of the output is in an ON display level and to an ON display voltage level when the display voltage level of the output is in an OFF display level.

8 Claims, 34 Drawing Sheets

DRIVE METHOD AND DRIVE UNIT FOR A LIQUID CRYSTAL DISPLAY DEVICE REDUCING VARIATION OF APPLIED VOLTAGE DEPENDENT UPON DISPLAY PATTERNS

BACKGROUND OF THE INVENTION

1. Field of the Invention

The present invention relates to a liquid crystal drive method and drive unit for driving a simple matrix liquid crystal panel.

2. Description of the Related Arts

Hitherto, a liquid crystal drive unit for driving a simple matrix liquid crystal panel is known.

This conventional liquid crystal drive unit has a liquid crystal panel 1 for displaying an image, as shown in FIG. 13, and to the liquid crystal panel 1 there is connected a segment driver 2 which is a segment-side drive unit and a common driver 3 which is a common-side drive unit. To the segment driver 2 and the common driver 3 there is connected a power supply circuit 4 for supplying an electric power and a controller 5 for sending out various kinds of control signals. A display data 6, a data latch clock 7 for taking in data, a horizontal synchronization signal 8, and an alternate signal 9 are input to the segment driver 2 from the controller 5. The horizontal synchronization signal 8 and a vertical synchronization signal 10 for recognizing the leading head of a 1 screen are input to the common driver 3 from the controller 5. Note that reference numerals 11 to 16 are liquid crystal drive power supply voltages.

The segment driver 2 is constituted by a shift register 21, a data latch circuit 22, a line latch circuit 23, a level shifter 24, and a liquid crystal drive output circuit 25, as shown in FIG. 14.

Now, the operation of this conventional example will be described with a time chart of FIG. 15.

The display data 6 for the 1 of an electrode and the data latch clock 7 for the 1 of an electrode are added to the segment driver 2 so that the display data 6 are shifted and input. If the display data 6 for the 1 of an electrode are accumulated, then the horizontal synchronization signal 8 will be added and the accumulated display data 6 will be loaded to the output side of the segment driver 2. According to a combination of the loaded display data 6 and the alternate signal 9, any one level voltage of the liquid crystal drive power supply voltages $V_o$ voltage 11, $V_2$ voltage 13, $V_3$ voltage 14, and $V_5$ voltage 16 of four levels is selected with respect to each data electrode, and the outputs of the segment driver for the 1 of an electrode are applied to the segment-side electrode in a parallel manner. On the other hand, in the common driver 3, the vertical synchronization signal 10 is taken in response to the horizontal synchronization signal 8, and initially the leading head line is selected. Then, selection lines are moved in sequence according to the horizontal synchronization signal 8. According to a combination of the scan signal for selecting lines in sequence and the alternate signal 9, any one level voltage of the liquid crystal drive power supply voltages $V_0$ voltage 11, $V_1$ voltage 12, $V_4$ voltage 15, and $V_5$ voltage 16 of four levels is selected and applied to the common-side electrode.

The display of the liquid crystal panel is determined by an effective voltage of a voltage difference in a 1 frame period which is the time needed for displaying the 1 screen of the segment driver and common driver outputs. Let "ON display" be known as the word ON being displayed on the screen, and let "OFF display" be known as the word OFF being displayed on the screen. Furthermore, let strip display be known a "ON" or "OFF" being displayed on the screen consecutively from top to bottom. In the liquid crystal panel 1, between a section which performs the same displays, for example, ON displays or OFF displays over the entire screen and a section which alternately repeats an ON display and an OFF display at intervals of a line, i.e., a stripe display, the displayed colors on the panel slightly differ even if they are all ON displays or OFF displays. That is, the shades of the colors differ. Now consider the output waveform of each driver of the case of the ON display over the entire screen. Since the segment waveform outputs only a V 0 or V 5 level which is an ON display voltage level by means of a combination of alternate signals during a 1 frame period, the effective voltage ($V_{eff1}$) is expressed by a difference between the segment waveform and the common waveform, such as that shown in FIG. 16.

Furthermore, consider the output waveform of each driver of the ON display of the case of the stripe display. Since the segment waveform alternately outputs V 0 and V 5 levels which are ON display voltage levels or V 2 and V 3 levels which are OFF display voltage levels at intervals of a horizontal synchronization signal (LP signal) during a 1 frame period, the effective voltage ($V_{eff2}$) is expressed by a difference between the segment waveform and the common waveform, such as that shown in FIG. 35. The difference between FIG. 16 and FIG. 35 is a difference between the number of changes of the output level of the segment waveform of FIG. 16 and the number of changes of the output level of the segment waveform of FIG. 35. Since the output waveform becomes dull due to the level change time, the capacity of liquid crystal, the electrode resistance of the liquid crystal panel, and the output resistance of the driver, the effective voltage will become smaller if the number of changes is increased. That is, in FIG. 16 a waveform null portion c is the difference between an a-portion and a b-portion, while in FIG. 35 a waveform null portion c' is the difference between an a'-portion and a b'-portion. Therefore, the c'-portion becomes larger than the c-portion.

For this reason, even if display pixels were the same ON display pixels, $V_{eff1}$, would be greater than $V_{eff2}$ and a shadowing would occur. Furthermore, if the output waveform of each driver in the case of the OFF display over the entire screen is considered, the effective voltage ($V_{eff3}$) will be expressed by a difference between the segment waveform and the common waveform, such as that shown in FIG. 36, because the segment waveform outputs only a V 2 or V 3 level during a 1 frame period. If the output waveform of each driver of the OFF display in the case of the stripe display is considered, the effective voltage ($V_{eff4}$) will be expressed by a difference between the segment waveform and the common waveform, such as that shown in FIG. 37, because the segment waveform alternately outputs V 0 and V 2 levels or V 3 and V 5 levels at intervals of an LP signal during a 1 frame period. As with the case of the ON display, the effective voltage becomes $V_{eff3} > V_{eff4}$ due to the difference between the segment waveforms, and consequently, the shadowing occurs.

On the other hand, a drive method and unit of a liquid crystal display unit for reducing the display shadowing wing dependent upon the display pattern in a liquid crystal display unit for driving a simple matrix liquid crystal panel is disclosed in Japanese Patent Application Laying Open (KOKAI) No. 5-265402. This conventional technique is a method where, in the drive method for the simple matrix liquid crystal display unit, a correction period is provided at intervals of a 1-line scanning period and a correction voltage of an intermediate voltage level between an ON display voltage level and an OFF display voltage level is output instead of a display voltage that is output by a column-side drive unit.

This conventional liquid crystal drive unit has a liquid crystal panel 1 for displaying an image, as shown in FIG. 17, and to the liquid crystal panel 1 there is connected a segment driver 2 which is a column-side drive unit and a common driver 3 which is a low-side drive unit. To the segment driver 2 and the common driver 3 there is connected a power supply circuit 4 for supplying an electric power and a controller 5 for sending out various kinds of control signals. To the controller 5 there is connected a counter 18 for counting a data latch clock 7 and a horizontal synchronization signal 8, and to the counter 18 there is connected a voltage selector 20 for selecting from the power supply circuit 4 a voltage to the segment driver 2. A display data 6, a data latch clock 7 for taking in data, a horizontal synchronization signal 8, and an alternate signal 9 are input to the segment driver 2 from the controller 5. The horizontal synchronization signal 8 and a vertical synchronization signal 10 for recognizing the leading head of a 1 screen are input to the common driver 3 from the controller 5. Note that reference numerals 11 to 16 are liquid crystal drive power supply voltages.

The output waveforms of the segment driver and the common driver become as shown in FIG. 18, and even in the case of the same display over the entire screen and the case of the stripe display, the output waveform changes to the intermediate level between the ON display voltage level and the OFF display voltage level at intervals of a 1-line scanning period, as evident in FIG. 18. Therefore, since the number of changes of the output of the segment driver becomes the same independently of display patterns, the variation in the effective value of an applied voltage, depending upon the display patterns is reduced.

On the other hand, another drive method and unit of a liquid crystal display unit for reducing the display shadowing wing dependent upon the display pattern in a liquid crystal display unit for driving a simple matrix liquid crystal panel is disclosed in Japanese Patent Application Laying Open (KOKAI) No. 3-130797. This conventional technique is a method where an ON display offset period and an OFF display offset period are provided in the segment output at intervals of a 1-line scanning period and the respective offset periods are provided at the start and the end of the 1-line scanning period. The partial constitution of the internal circuit of this segment driver is shown in FIG. 19, and the output waveforms of the segment driver and the common driver are shown in FIG. 20. As evident in FIG. 20, the number of changes of the output of the segment driver becomes the same independent of display patterns, and the variation in the effective value of an applied voltage dependent upon the display patterns is reduced.

However, in order to output the intermediate level between the ON display voltage level and the OFF display voltage level, the voltage selector 20 needs to be added to the conventional power supply circuit, as shown in FIG. 17, and the total cost of the liquid crystal display system is increased due to that voltage selector. Furthermore, in a case where a function which outputs the intermediate level between the ON display voltage level and the OFF display voltage level is provided in the segment driver, there is the problem that the output transistors and power supply lines for the intermediate level are needed and the cost of the driver is increased.

In addition, in a case where the ON display offset period and the OFF display offset period are provided before and after the scanning period, the number of output changes of the segment driver becomes equal independent of display patterns, but since the number of changes is increased, the consumption power in the driver will be caused to increase.

The present invention has been made in order to overcome problems such as described above.

Accordingly, it is an object of the present invention to provide a drive method and a drive unit for a liquid crystal display unit which reduce a variation in an effective value of an applied voltage of liquid crystal dependent upon the display patterns, are inexpensive, enhance display quality, and reduce the consumption current.

SUMMARY OF THE INVENTION

In accordance with one important aspect of the present invention, there is provided a drive method for a simple matrix liquid crystal display unit which performs a liquid crystal display by controlling segment-side liquid crystal drive means and common-side liquid crystal drive means by a controller, wherein an output correction period is provided in an output of said segment-side liquid crystal drive means at intervals of a 1-line scanning period and wherein during said output correction period a display voltage level of said output is set to an OFF display voltage level when said display voltage level of said output is in an ON display level and to an ON display voltage level when said display voltage level of said output is in an OFF display level.

In accordance with another important aspect of the present invention, there is provided a drive method for a simple matrix liquid crystal display unit which performs a liquid crystal display by controlling segment-side liquid crystal drive means and common-side liquid crystal drive means by a controller, wherein: an output correction period is provided in an output of said segment-side liquid crystal drive means at intervals of a 1-line scanning period; outputs of two successive scans are compared; and if said outputs of two successive scans are the same, during said output correction period a display voltage level of said output is set to an OFF display voltage level when said display voltage level of said output is in an ON display level and to an ON display voltage level when said display voltage level of said output is in an OFF display level.

In accordance with still another important aspect of the present invention, there is provided a drive unit for a simple matrix liquid crystal display unit which includes segment-side liquid crystal drive means, common-side liquid crystal drive means, and a controller for controlling said two means, wherein: said controller or said segment-side liquid crystal drive means includes correction clock means for generating a correction clock prescribing a correction period of an output of said segment-side drive means; and said segment-side liquid crystal drive means includes an output control means which, at intervals of a 1-line scanning period, detects said correction clock to provide an output correction period and which, during said output correction period, sets a display voltage level of said output to an OFF display voltage level when said display voltage level of said output is in an ON display level and to an ON display voltage level when said display voltage level of said output is in an OFF display level.

In accordance with a further important aspect of the present invention, there is provided a drive unit for a simple matrix liquid crystal display unit which includes segment-side liquid crystal drive means, common-side liquid crystal drive means, and a controller for controlling said two means, wherein: said segment-side liquid crystal drive means includes correction clock means for generating a correction clock prescribing a correction period of an output of said segment-side drive means; said correction clock means generates said correction clock, based on a horizontal synchronization signal and a data latch clock which are input by said controller; and said segment-side liquid crystal drive means includes an output control means which, at intervals of a 1-line scanning period, detects said correction clock to provide an output correction period and which, during said output correction period, sets a display voltage level of said output to an OFF display voltage level when said display voltage level of said output is in an ON display level and to an ON display voltage level when said display voltage level of said output is in an OFF display level.

In accordance with a preferred form of the present invention, said output control means is constituted by a clock gate or a selector.

In accordance with a further important aspect of the present invention, there is provided a drive unit for a simple matrix liquid crystal display unit which includes segment-side liquid crystal drive means, common-side liquid crystal drive means, and a controller for controlling said two means, wherein: said controller or said segment-side liquid crystal drive means includes correction clock means for generating a correction clock prescribing a correction period of an output of said segment-side drive means; and said segment-side liquid crystal drive means includes an output control means which, at intervals of a 1-line scanning period, detects said correction clock to provide an output correction period and which compares outputs of two successive scans and, if said outputs of two successive scans are the same, sets during said output correction period a display voltage level of said output to an OFF display voltage level when said display voltage level of said output is in an ON display level and to an ON display voltage level when said display voltage level of said output is in an OFF display level.

In accordance with a further important aspect of the present invention, there is provided a drive unit for a simple matrix liquid crystal display unit which includes segment-side liquid crystal drive means, common-side liquid crystal drive means, and a controller for controlling said two means, wherein: said segment-side liquid crystal drive means includes correction clock means for generating a correction clock prescribing a correction period of an output of said segment-side drive means; said correction clock means generates said correction clock, based on a horizontal synchronization signal and a data latch clock which are input by said controller; and said segment-side liquid crystal drive means includes an output control means which, at intervals of a 1-line scanning period, detects said correction clock to provide an output correction period and which compares outputs of two successive scans and, if said outputs of two successive scans are the same, sets during said output correction period a display voltage level of said output to an OFF display voltage level when said display voltage level of said output is in an ON display level and to an ON display voltage level when said display voltage level of said output is in an OFF display level.

In the drive method of the liquid crystal display unit of the present invention, the correction period is provided in the output of the segment-side liquid crystal drive unit at intervals of a 1-line scanning period, and during the correction period the liquid crystal drive output level is set to an OFF display voltage level when the display voltage level is in an ON display level and to an ON display voltage level when the display voltage level is in an OFF display level. With this arrangement, the pulse width of the correction clock is regulated so that it becomes equal to the reduction amount of the effective value of the applied voltage of the liquid crystal caused by the waveform dull which occurs as the output level of the segment-side liquid crystal drive unit changes. That is, the correction clock pulse width is actually regulated by viewing the display state (part of data within a 1 H period is removed). As a result, independently of the display data of the liquid crystal panel, the variation in the effective value of the applied voltage of the liquid crystal can be reduced. In addition, the present invention can be realized with the power supply circuit of the conventional liquid crystal display system, because the output voltage level during the correction period is set to an OFF display voltage level when the display voltage level is in an ON display level and to an ON display voltage level when the display voltage level is in an OFF display level.

In the drive method of the liquid crystal display unit of the present invention, the correction period is provided in the output of the segment-side liquid crystal drive unit at intervals of a 1-line scanning period, and only when the output of the segment-side liquid crystal drive unit is the same as the previous line or the following line, during the correction period the liquid crystal drive output level is set to an OFF display voltage level when the display voltage level is in an ON display level and to an ON display voltage level when the display voltage level is in an OFF display level. With this arrangement, the pulse width of the correction clock is regulated so that it becomes equal to the reduction amount of the effective value of the applied voltage of the liquid crystal caused by the waveform dull which occurs as the output level of the segment-side liquid crystal drive unit changes. That is, the correction clock pulse width is actually regulated by viewing the display state (part of data within a 1 H period is removed). As a result, independently of the display data of the liquid crystal panel, the variation in the effective value of the applied voltage of the liquid crystal can be reduced. In addition, the present invention can be realized with the power supply circuit of the conventional liquid crystal display system, because the output voltage level during the correction period is set to an OFF display voltage level when the display voltage level is in an ON display level and to an ON display voltage level when the display voltage level is in an OFF display level. Furthermore, only when the output of the segment-side liquid crystal drive unit is the same as the previous line or the following line, during the correction period the liquid crystal drive output level is set to an OFF display voltage level when the display voltage level is in an ON display level and to an ON display voltage level when the display voltage level is in an OFF display level. Therefore, since the number of changes of the segment driver can be suppressed, there can be realized a liquid crystal display method which suppresses consumption current.

In the drive unit of the liquid crystal display unit of the present invention, the correction period is provided in the output of the segment-side liquid crystal drive unit at intervals of a 1-line scanning period by the voltage control means incorporated in the segment-side liquid crystal drive unit, and during the correction period the liquid crystal drive output level is set to an OFF display voltage level when the display voltage level is in an ON display level and to an ON display voltage level when the display voltage level is in an OFF display level. With this arrangement, a liquid crystal display unit which is inexpensive and enhances display quality can be realized because only a mechanism which inverts the display data is provided in the correction period.

In the drive unit of the present invention, since the voltage control means is constituted by a clocked gate or a selector, costs can be reduced by a simple circuit.

In the drive unit of the liquid crystal display unit of the present invention, the correction period is provided in the output of the segment-side liquid crystal drive unit at intervals of a 1-line scanning period by the voltage control means incorporated in the segment-side liquid crystal drive unit only when the output of the segment-side liquid crystal drive unit is the same as the previous line or the following line, during the correction period the liquid crystal drive output level is set to an OFF display voltage level when the display voltage level is in an ON display level and to an ON display voltage level when the display voltage level is in an OFF display level. With this arrangement, a liquid crystal display unit which is inexpensive and enhances display quality can be realized because only a mechanism which inverts the display data is provided in the correction period. In addition, since the number of changes of the segment driver can be suppressed, there can be realized a liquid crystal display unit which suppresses consumption current.

Further objects and advantages of the present invention will be apparent from the following description of the preferred embodiments of the present invention as illustrated in the accompanying drawings.

DESCRIPTION OF THE PREFERRED EMBODIMENTS

A first embodiment of the present invention will hereinafter be described while referring to the accompanying drawings.

Figure 1:
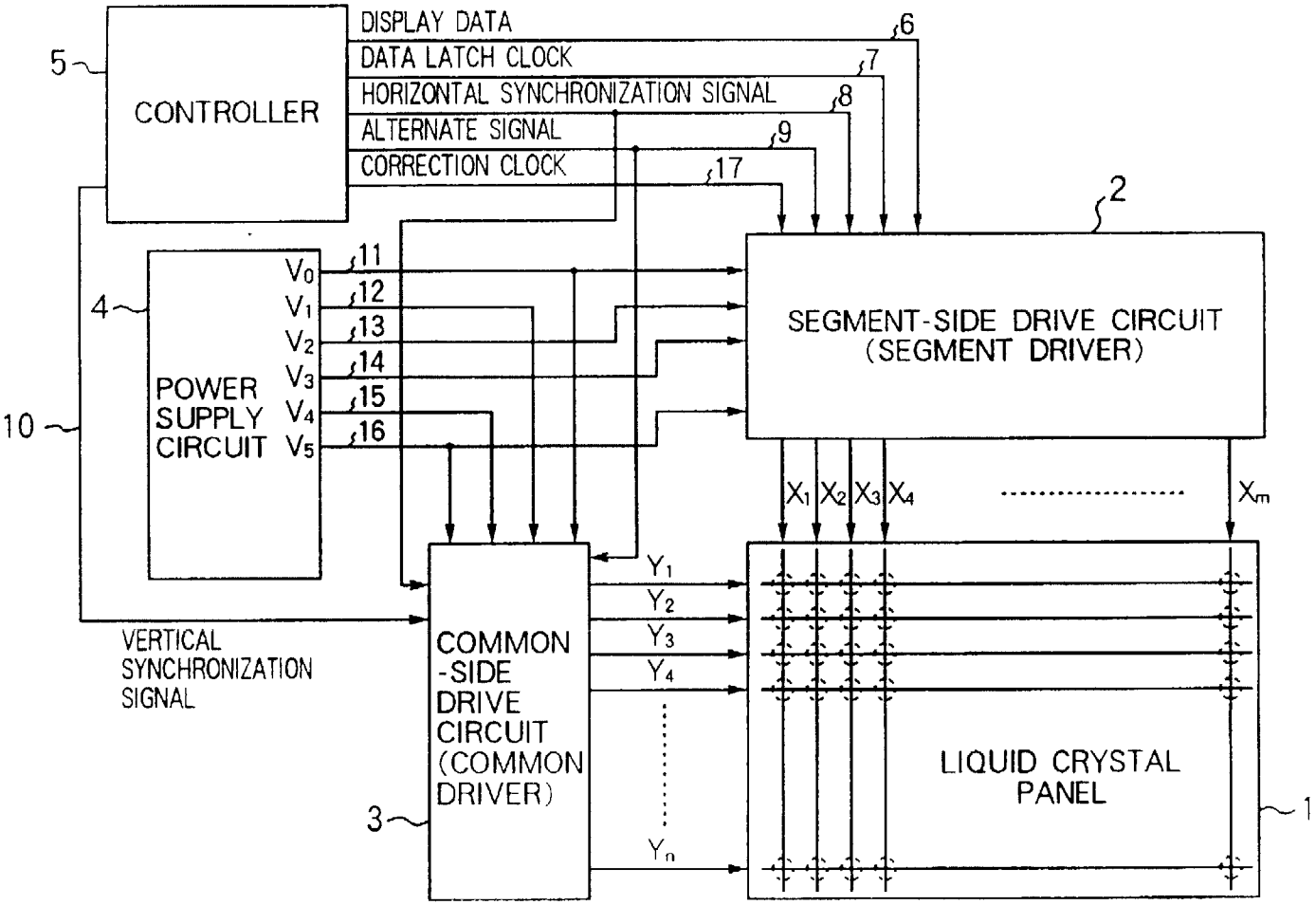
FIG. 1 illustrates the constitution of an embodiment of a liquid crystal display unit of the present invention.
Figure 2:
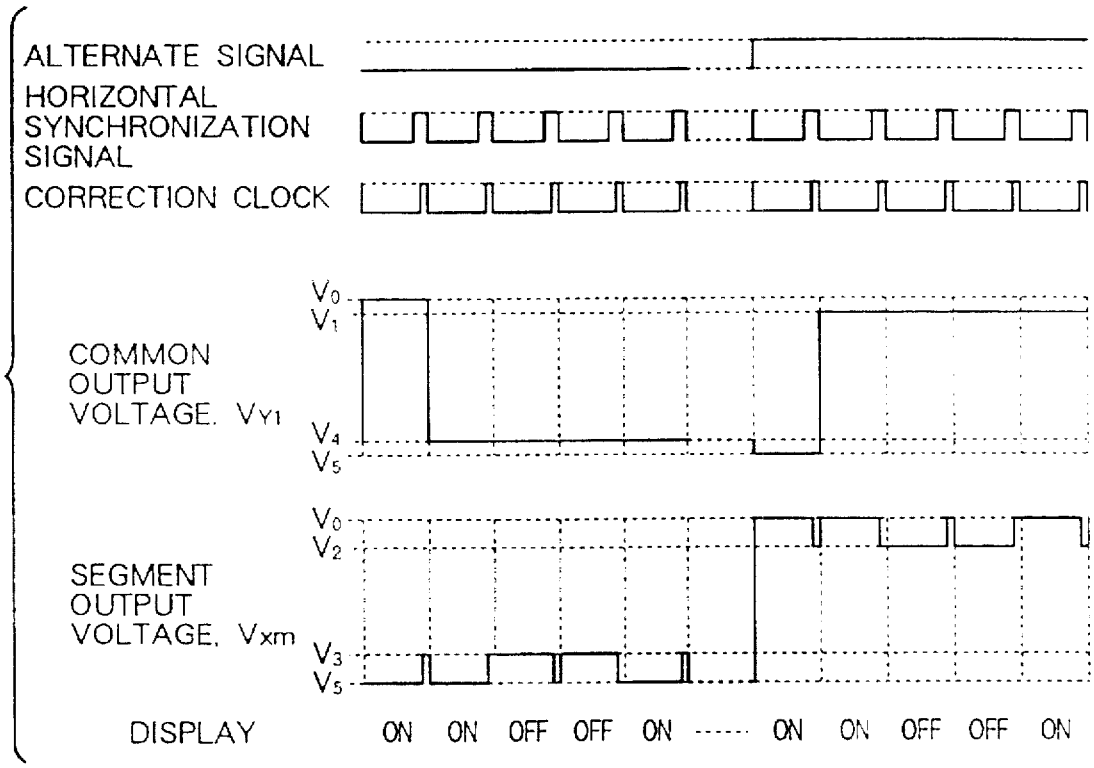
FIG. 2 illustrates the timing of the liquid crystal display unit of the present invention.

A liquid crystal drive unit of this embodiment has a liquid crystal panel 1 for displaying an image, as shown in FIG. 1, and to the liquid crystal panel 1 there is connected a segment driver 2 which is a segment-side drive unit and a common driver 3 which is a common-side drive unit. To the segment driver 2 and the common driver 3 there is connected a power supply circuit 4 for supplying an electric power and a controller 5 for sending out various kinds of control signals. A display data 6, a data latch clock 7 for taking in data, a horizontal synchronization signal 8, an alternate signal 9, and a correction clock 17 for determining a correction period are input to the segment driver 2 from the controller 5. The horizontal synchronization signal 8 and a vertical synchronization signal 10 for recognizing the leading head of a 1screen are input to the common driver 3 from the controller 5. Note that reference numerals 11 to 16 are liquid crystal drive power supply voltages.

Figure 4:
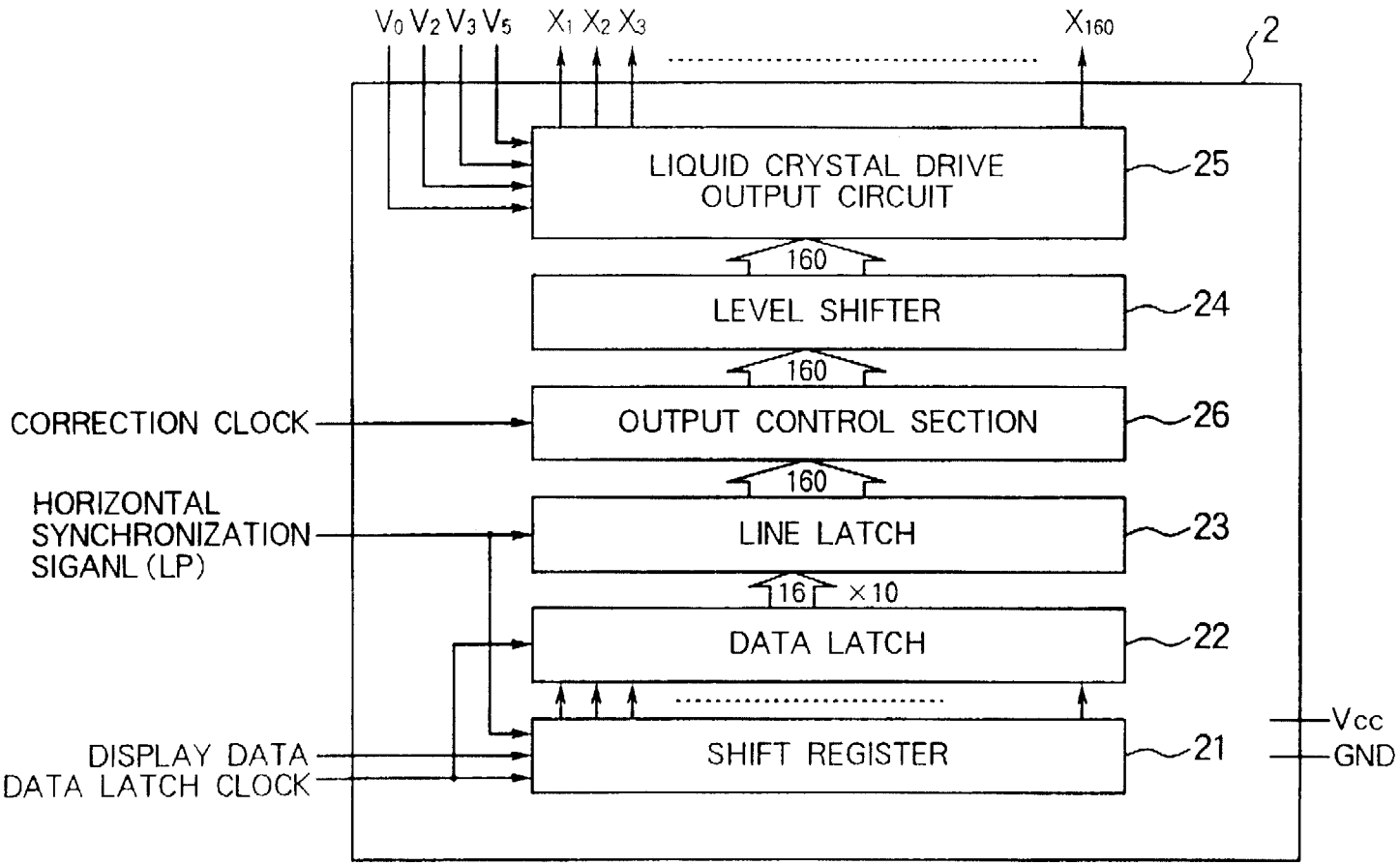
FIG. 4 illustrates the constitution of the segment driver of the liquid crystal drive unit of the present invention.

The segment driver 2 is constituted by a shift register 21, a data latch circuit 22, a line latch circuit 23, an output control section 26 serving as a voltage control means, a level shifter 24, and a liquid crystal drive output circuit 25, as shown in FIG. 4.

Figure 5:
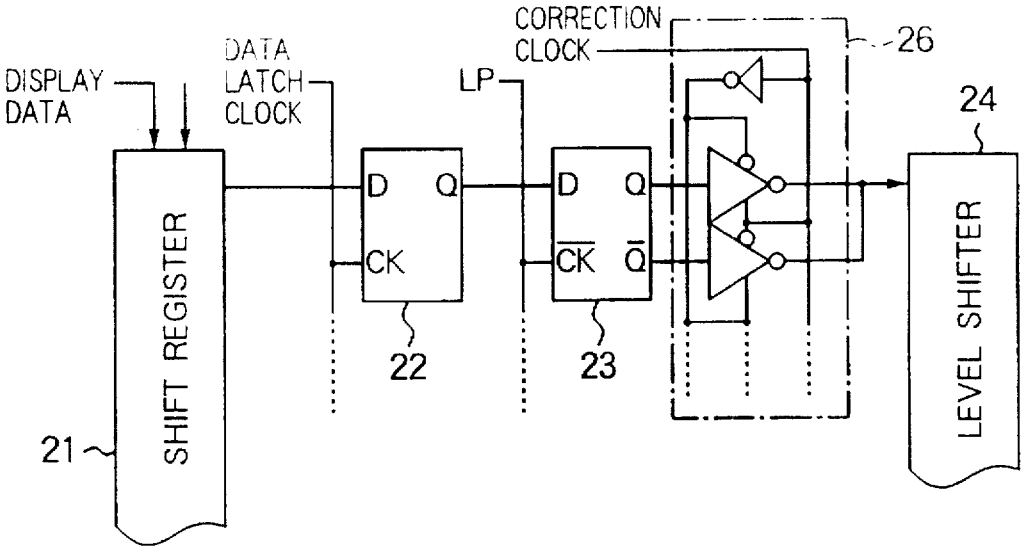
FIG. 5 illustrates the constitution of an output control section of the segment driver of the liquid crystal drive unit of the present invention.
Figure 6:
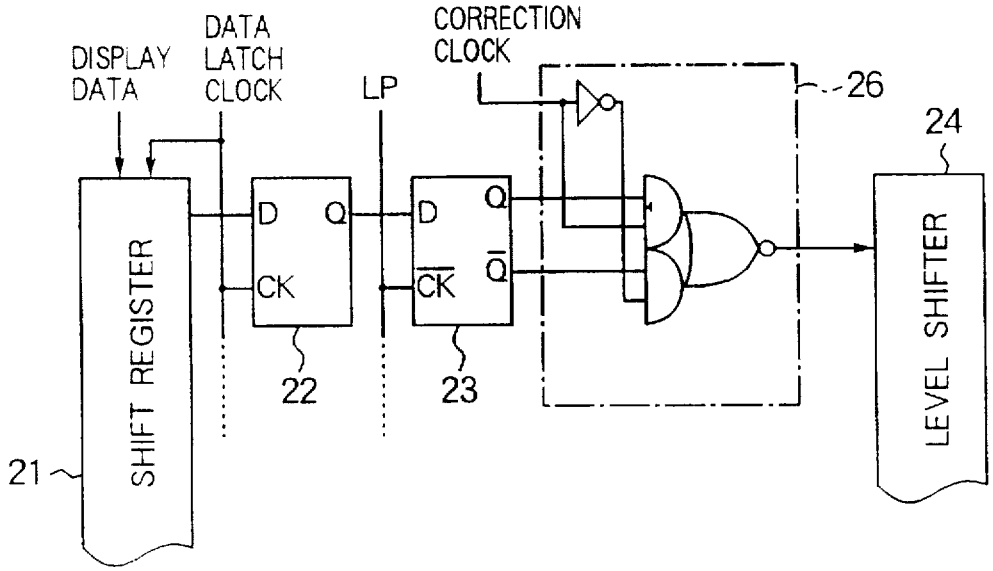
FIG. 6 illustrates the constitution of an output control section of the segment driver of the liquid crystal drive unit of the present invention.
Figure 7:
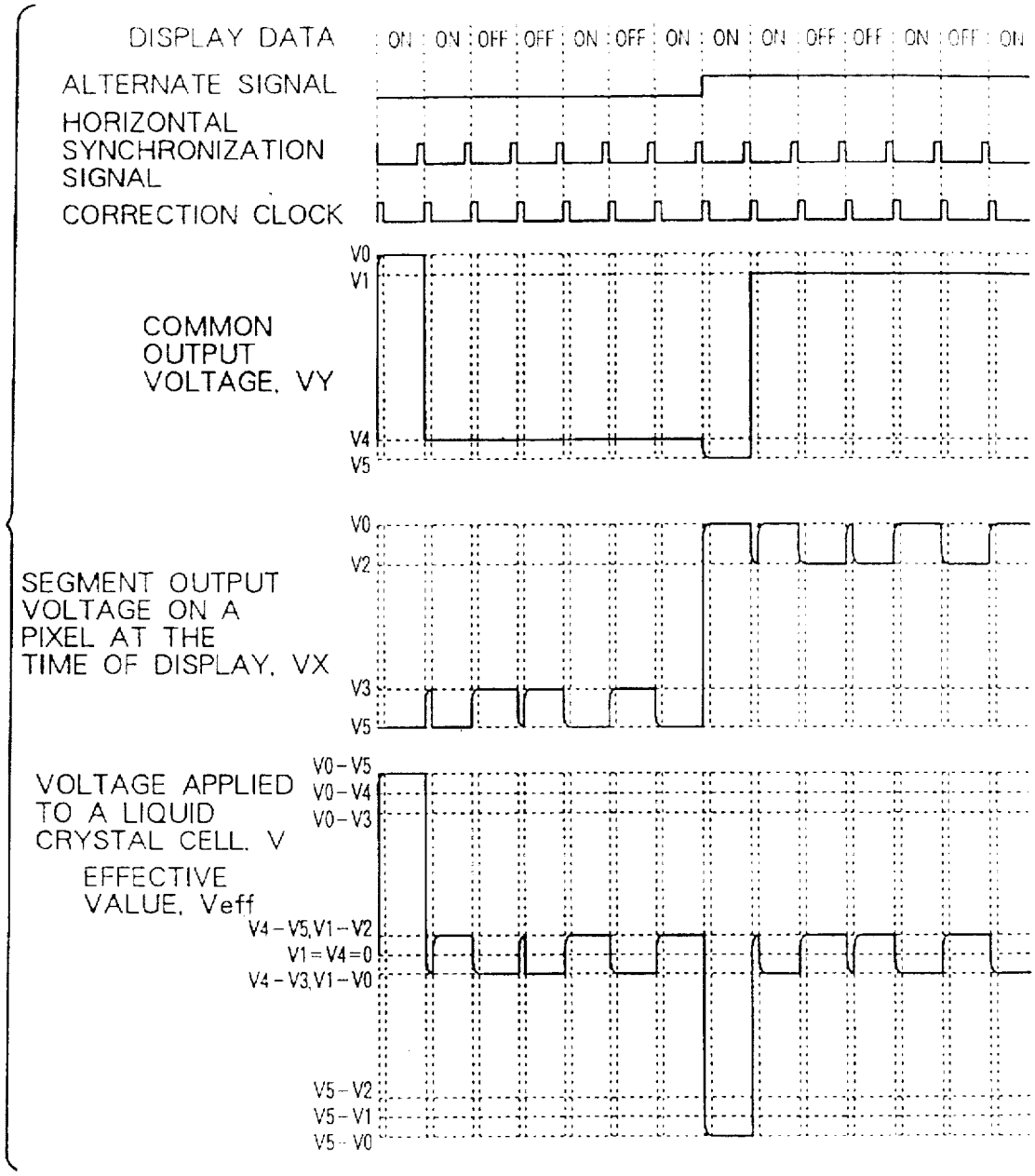
FIG. 7 illustrates the timing of the liquid crystal display unit of the present invention.

The output control section 26 can be constituted by a clocked gate, as shown in FIG. 5. Also, the output control section 26 may be constituted by a selector, as shown in FIG. 6.

Now, the operation of this embodiment will be described along timing charts of FIGS. 2 and 3 and FIGS. 29 to 31.

The display data 6 for the 1 scan of an electrode and the data latch clock 7 for the 1 scan of an electrode are added to the segment driver 2 so that the display data 6 are shifted and input. If the display data 6 for the 1 scan of an electrode are accumulated, then the horizontal synchronization signal 8 will be added and the accumulated display data 6 will be loaded to the output side of the segment driver 2. According to a combination of the loaded display data 6 and the alternate signal 9, any one level voltage of the liquid crystal drive power supply voltages $V_0$ voltage 11, $V_2$ voltage 13, $V_3$ voltage 14, and V. Voltage 16 of four levels is selected with respect to each data electrode, and the outputs of the segment driver for the 1 of an electrode are applied to the segment-side electrode in a parallel manner. At this time, if the correction clock 17 which is generated by the controller 5 is added to the segment driver 2, then the display data 6, loaded during the period of the correction clock, will be reflected. And, according to a combination of the reflected display data 6 and the alternate signal 9, any one level voltage of the liquid crystal drive power supply voltages $V_0$ voltage 11, $V_2$ voltage 13, $V_3$ voltage 14, and $V_5$ voltage 16 of four levels is selected.

Figure 3:
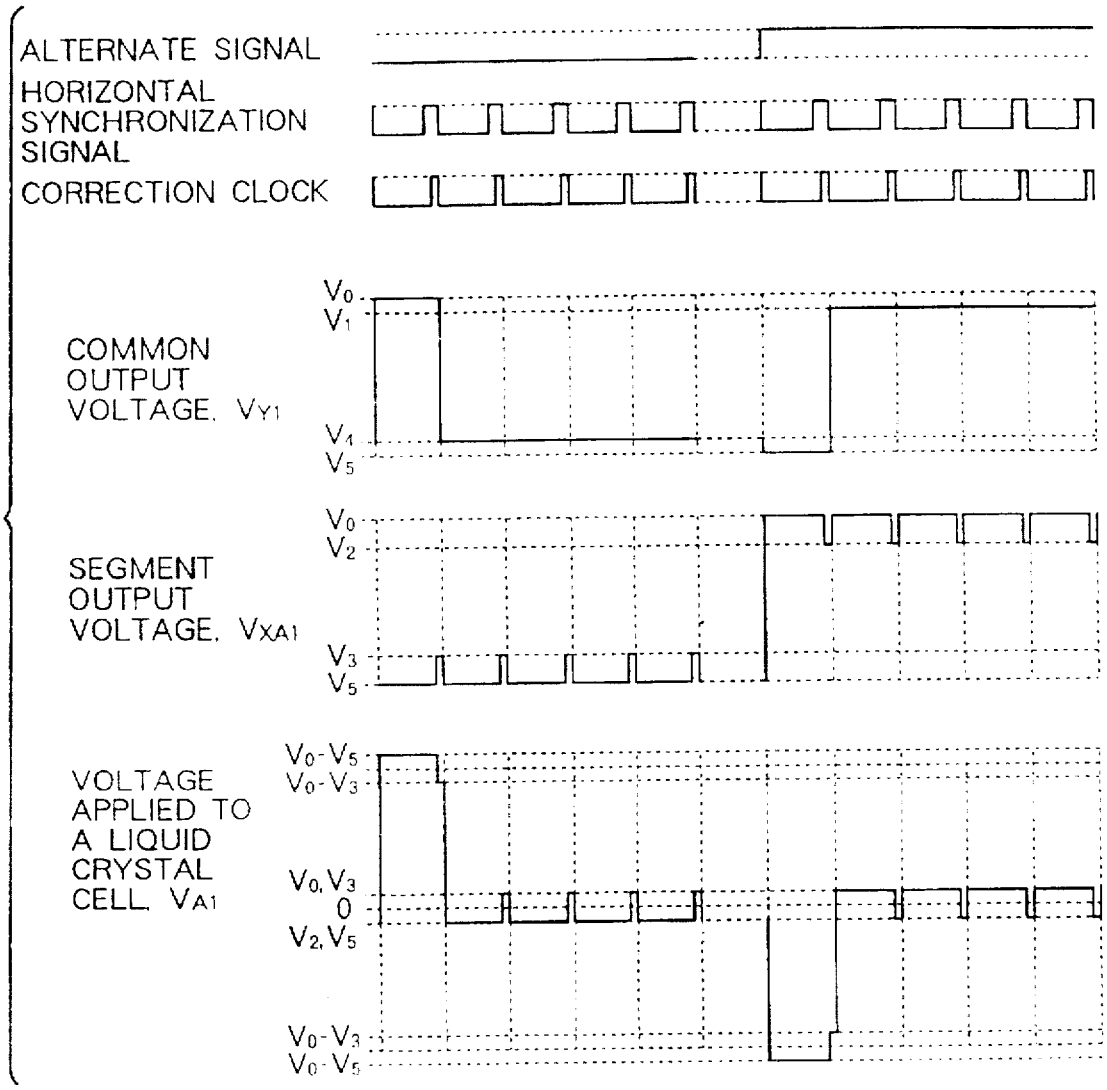
FIG. 3 illustrates the output waveform of each driver of the liquid crystal display unit of the present invention and also the applied voltage waveform that is applied to the liquid crystal cell.
Figure 29:
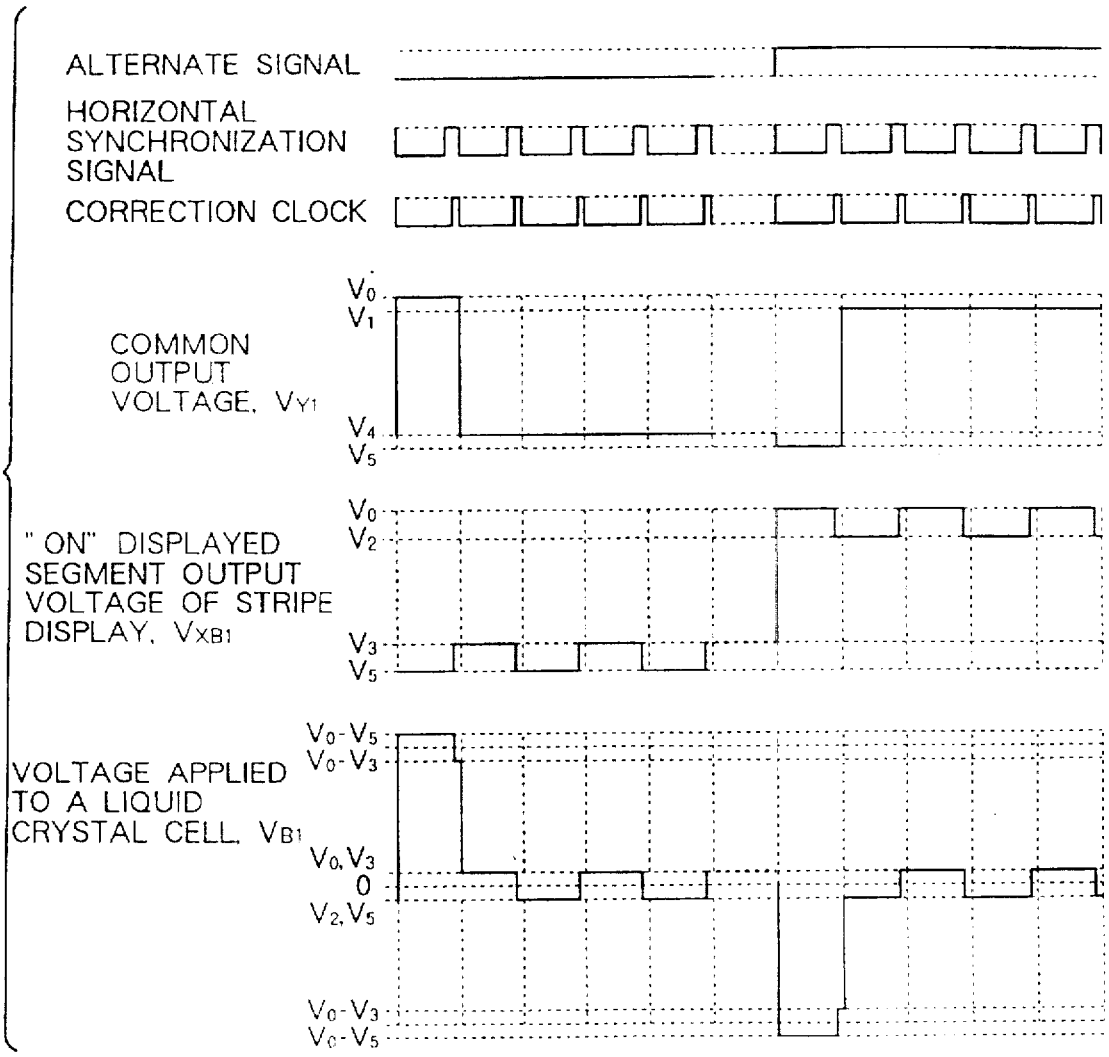
FIG. 29 illustrates the output waveform of each driver of the liquid crystal display unit of the present invention and also the applied voltage waveform that is applied to the liquid crystal cell.
Figure 30:
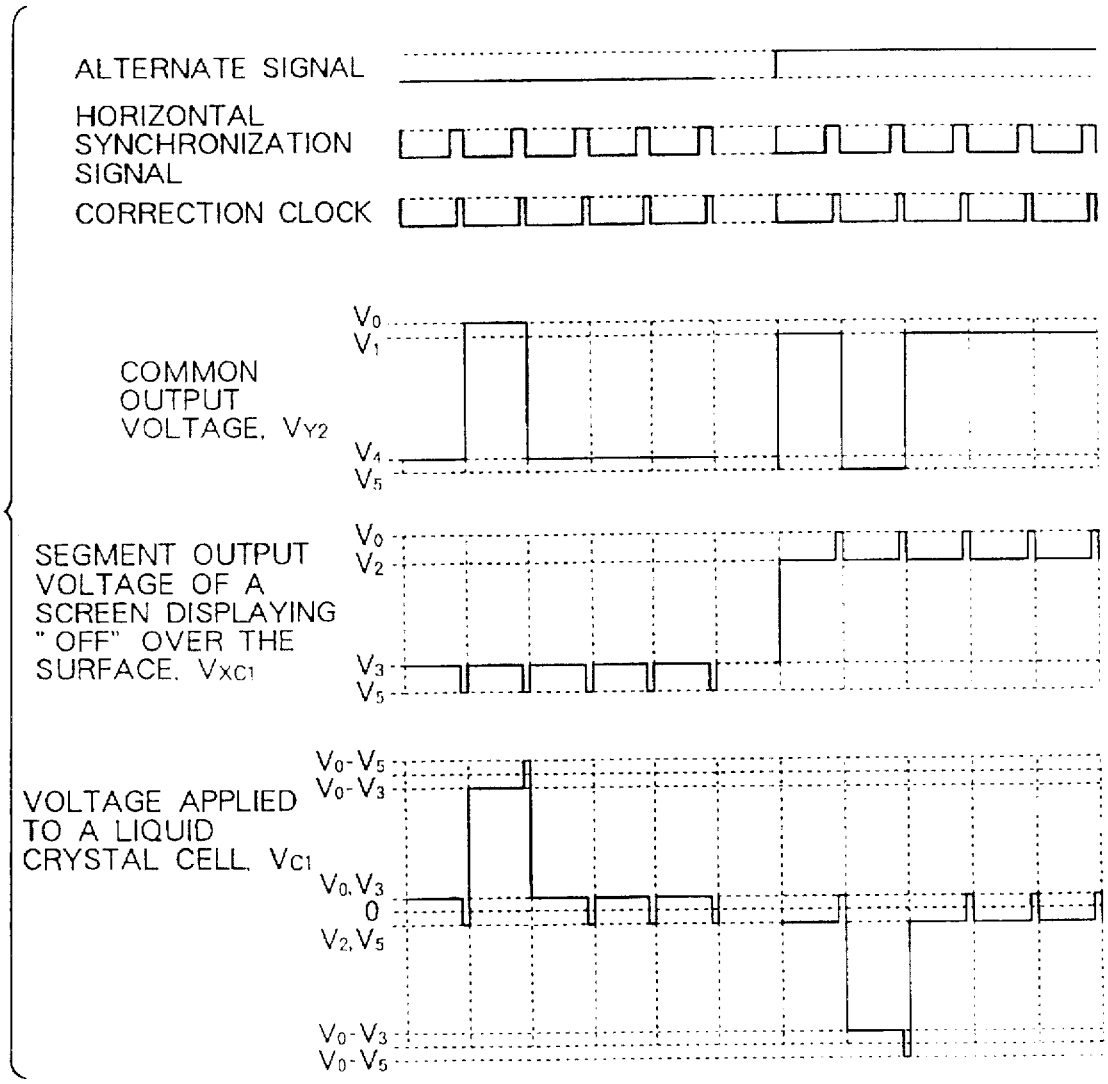
FIG. 30 illustrates the output waveform of each driver of the liquid crystal display unit of the present invention and also the applied voltage waveform that is applied to the liquid crystal cell.
Figure 31:
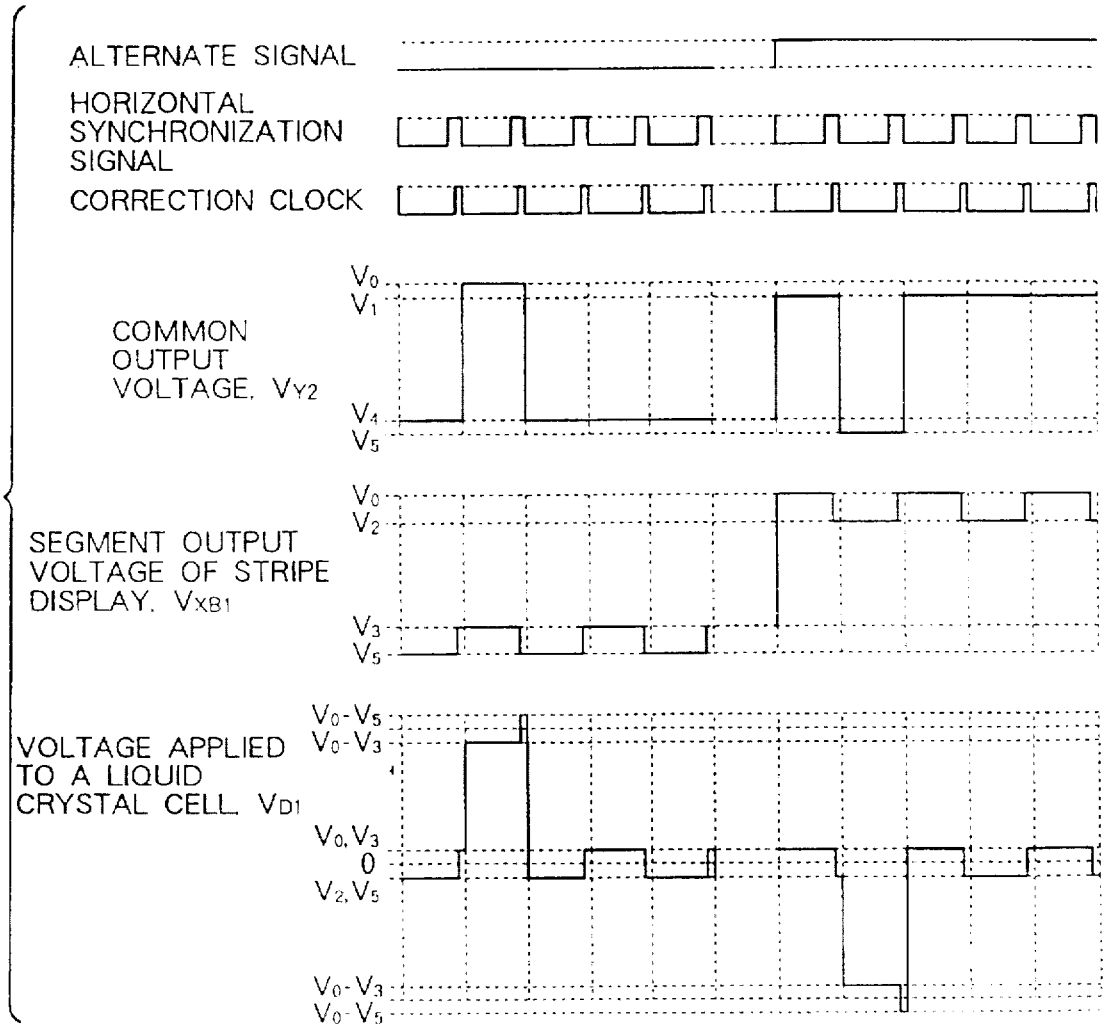
FIG. 31 illustrates the output waveform of each driver of the liquid crystal display unit of the present invention and also the applied voltage waveform that is applied to the liquid crystal cell.

FIG. 3 illustrates the output waveform of each driver in the case of the ON display over the entire screen and also a voltage waveform which is applied to a liquid crystal cell, and FIG. 29 illustrates the output waveform of each driver in the case of the stripe display and also a voltage waveform which is applied to a liquid crystal cell. FIG. 30 illustrates the output waveform of each driver in the case of the OFF display over the entire screen and also a voltage waveform which is applied to a liquid crystal cell. FIG. 31 illustrates the output waveform of each driver in the case of the stripe display and also a voltage waveform which is applied to a liquid crystal cell. The effective voltages of FIGS. 3 and 29 and of FIGS. 30 and 31 become equal to each other by controlling the pulse width of the correction clock so that it becomes equal to the reduction amount of the effective voltage caused by the waveform dull, and consequently, the shadowing that is caused by a difference in the display data is reduced.

From FIGS. 4 and 5, by switching with the correction clock the display data and the inverted data which have been taken in the line latch of the conventional segment driver, the correction period is provided in the output of the segment-side liquid crystal drive unit at least once at intervals of a 1-line scanning period, and during the correction period, the liquid crystal drive output level can be switched to the OFF display voltage level when the display voltage level is in the ON display voltage level and to the ON display voltage level when the display voltage level is in the OFF display voltage level. Therefore, a liquid crystal display unit which is inexpensive and enhances display quality can be realized.

Furthermore, the correction clock is not only a method of generating the clock from the controller but also it can be internally generated by providing a counter in the interior of the segment driver. In such a case, with the constitution of the conventional liquid crystal display system, the correction period is provided in the output of the segment-side liquid crystal drive unit at least once at intervals of a 1-line scanning period, and during the correction period, the liquid crystal drive output level can be switched to the OFF display voltage level when the display voltage level is in the ON display voltage level and to the ON display voltage level when the display voltage level is in the OFF display voltage level.

Now, a description will be made of the difference between the display unit of the present invention and the conventional display control unit disclosed in the aforementioned Japanese Patent Application Laying Open (KOKAI) No. 3-130797 which the applicant has already proposed.

Figure 21:
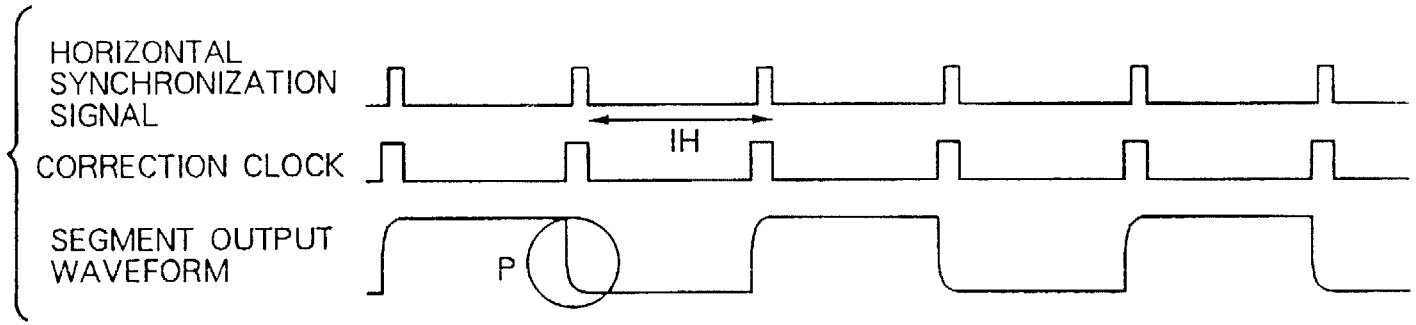
FIG. 21 illustrates the timing of the segment output waveform as the stripe display of the present invention is performed.

FIG. 21 illustrates the segment output waveform of the case where a black-and-white display such as a stripe display is performed at intervals of a pixel by the display unit of the present invention. The black and white of the display data are inverted during the H period (correction period) of a correction clock so that the correction period is provided in the case of the same display and the shadowing which is caused by a difference in display data is reduced. Therefore, when a black-and-white display such as a stripe display is performed at intervals of a pixel, the output waveform becomes the almost same output waveform as the conventional unit, and consequently, it is possible to suppress the reduction in the effective voltage due to the correction period to the minimum.

Figure 22:
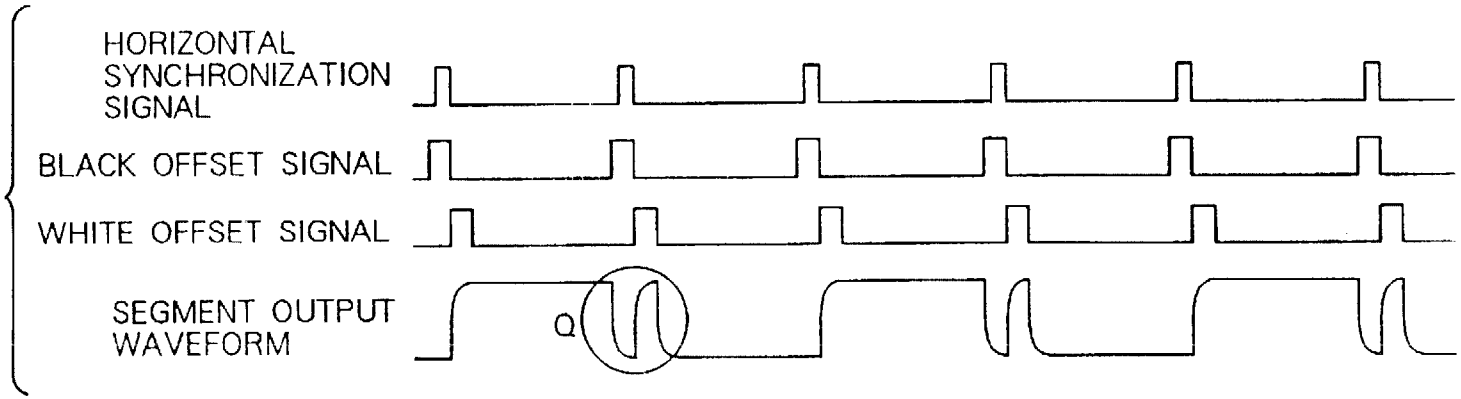
FIG. 22 illustrates the timing of the segment output waveform as the stripe display is performed in the conventional display control unit.

FIG. 22 illustrates the segment output waveform of the case where a black-and-white display such as a stripe display is performed at intervals of a pixel by the conventional display control unit disclosed in the aforementioned Japanese Patent Application Laying Open (KOKAI) No. 3-130797, which the applicant has already proposed. In the conventional display control unit, fixed black offset and white offset periods are provided before and after a horizontal synchronization signal so that either or both of the offset periods are provided independent of display data and the shadowing which is caused by a difference in display data is reduced. Therefore, in a case where a black-and-white display such as a stripe display is performed at intervals of a pixel, both of the offset periods exist when a white display exists next to a black display, as shown in FIG.

22. For this reason, there is the possibility that the reduction in the effective voltage due to the correction period becomes large as compared to the drive unit of the present invention. That is, as evident from a waveform P of FIG. 21 and a waveform Q of FIG. 22, the effective value becomes all the smaller because in FIG. 22 the white-black (ON-OFF) inversion is performed in sequence for a short period of time. In the present invention shown in FIG. 21, the display data is inverted only during the correction period, but in the conventional unit, the black-white inverting data is put in the correction period twice independently of display data. For this reason, it has been confirmed that the effective value is further reduced in the conventional unit than in the present invention. This is particularly remarkable in the case of the stripe display.

Figure 23:
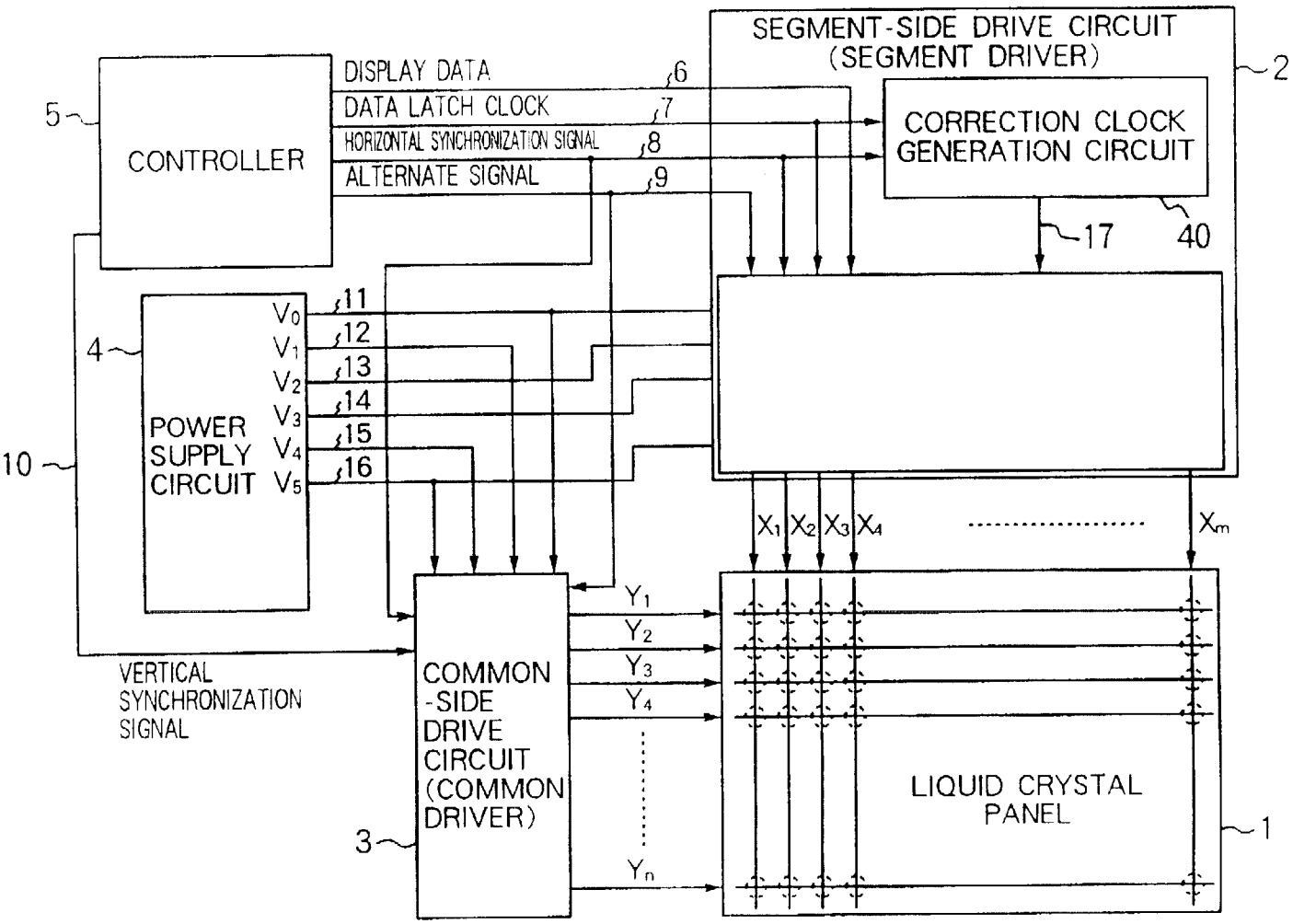
FIG. 23 illustrates the constitution of another embodiment of a liquid crystal display unit of the present invention.

Now, another embodiment of the present invention will be described while referring to the drawings. FIG. 23 is a block diagram of this embodiment.

The point of difference with the aforementioned first embodiment is in that a correction clock generation circuit 40 is incorporated in a segment-side drive circuit 2 and also the correction clock generation circuit 40 generates a correction clock 17, based on a horizontal synchronization signal 8 and a data latch clock 7 which are input by a controller 5. The other constitutional members are the same as the aforementioned first embodiment. With this arrangement, a correction clock generation function is unnecessary on the controller side, so a general purpose controller can be used as the controller 5. Furthermore, a reduction in the number of the terminals of the segment driver 2 becomes possible. In addition, there is no need to provide a correction clock line on a mounting printed-circuit board.

Figure 24:
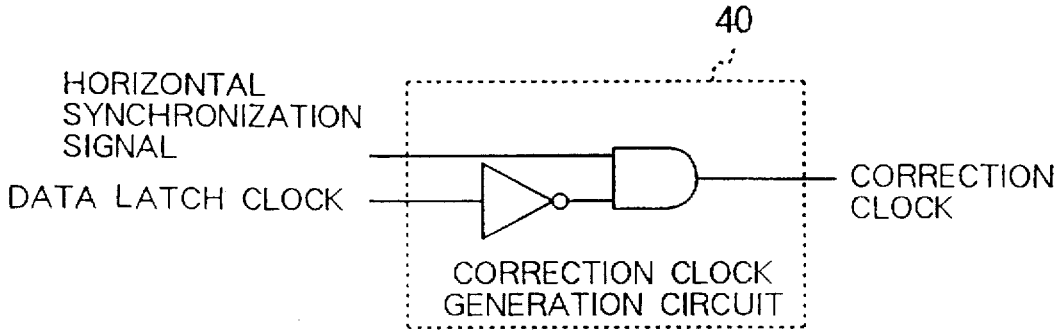
FIG. 24 illustrates the constitution of an example of the correction clock generation circuit.
Figure 25:
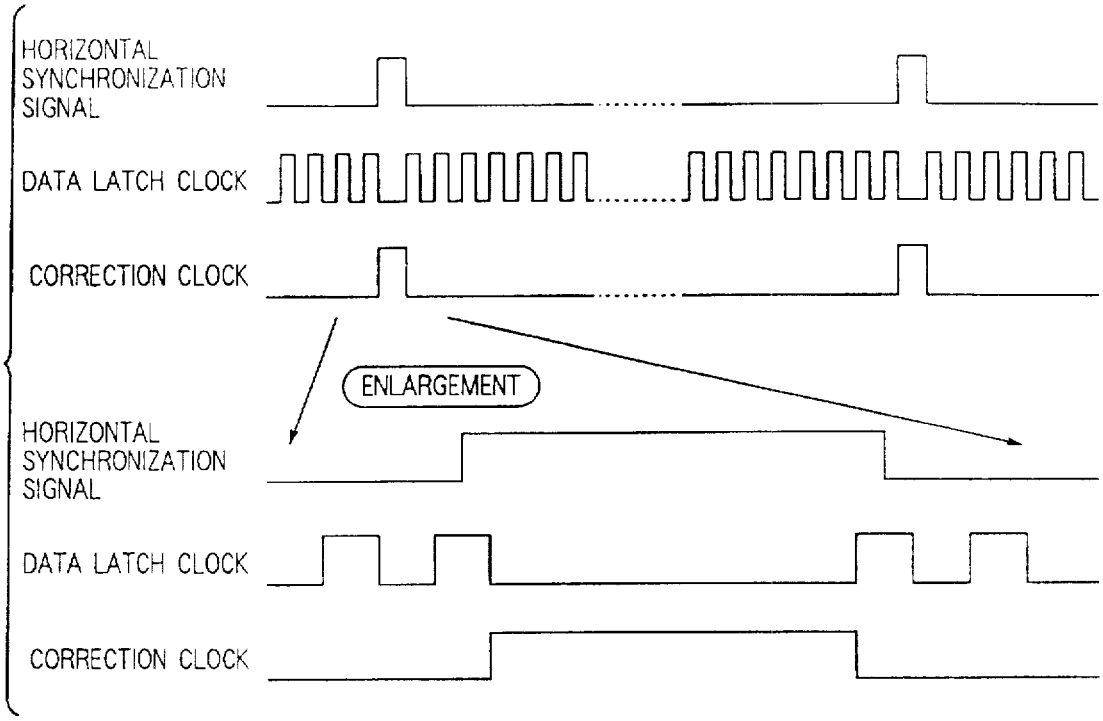
FIG. 25 illustrates the operational timing of the correction clock generation circuit of FIG. 24.

A first example of the correction clock generation circuit 40 is shown in FIG. 24 and the operational timing diagram is shown in FIG. 25. In this example, the correction clock is the conjunction between the horizontal synchronization signal 8 and the inverted signal of the data latch clock 7.

Figure 26:
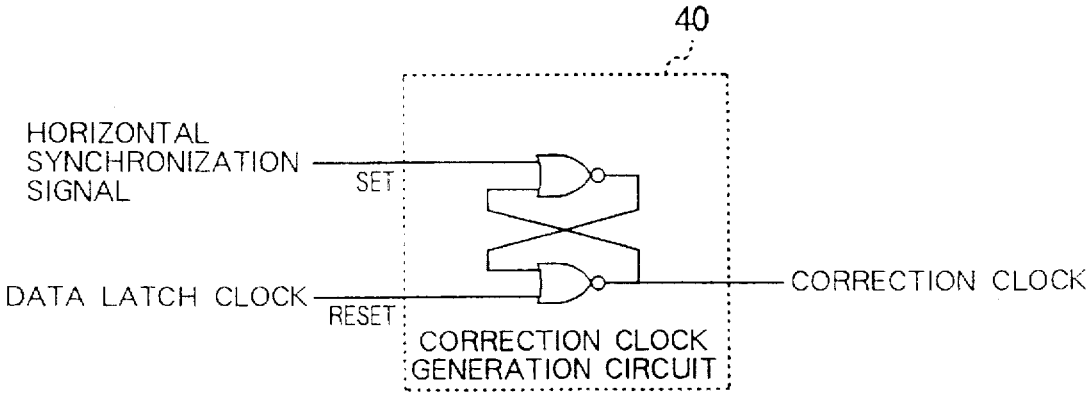
FIG. 26 illustrates the constitution of another example of the correction clock generation circuit.
Figure 27:
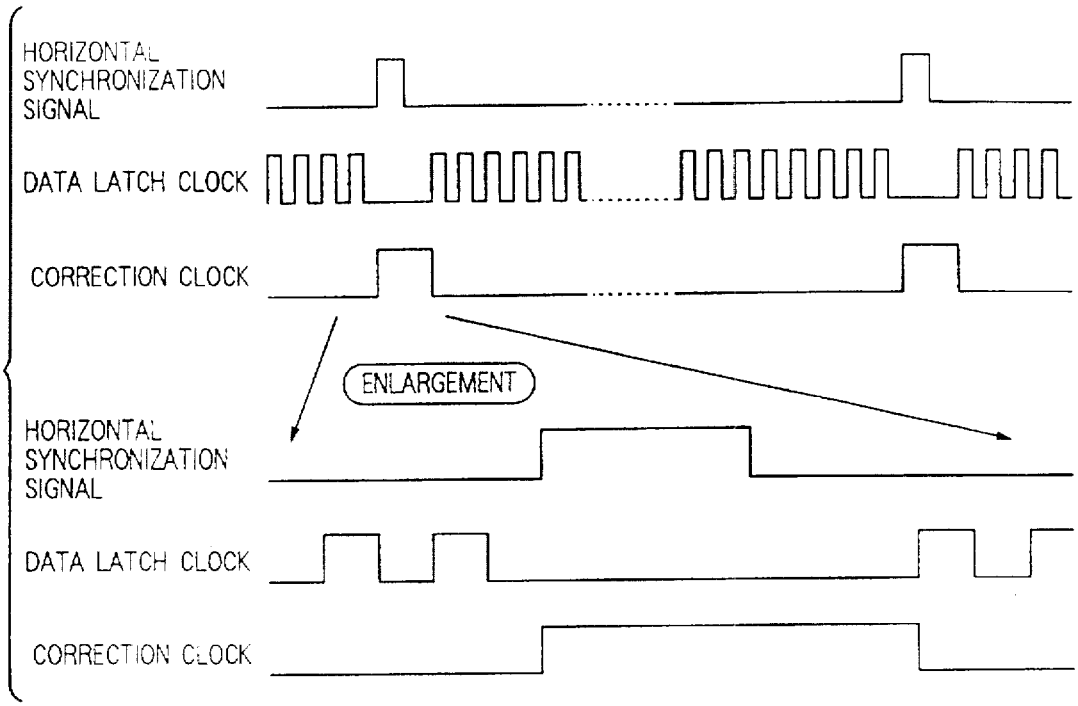
FIG. 27 illustrates the operational timing of the correction clock generation circuit of FIG. 26.
Figure 28:
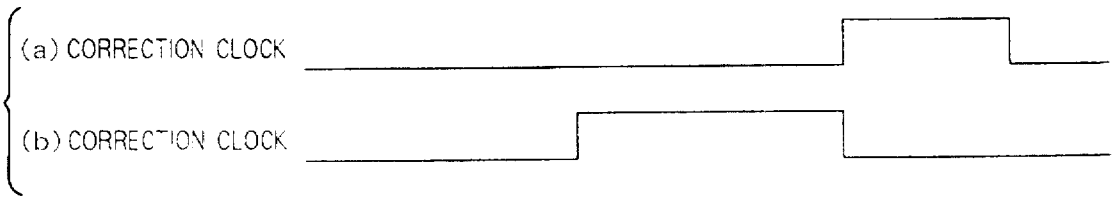
FIG. 28 illustrates the waveforms of other correction clocks.

A second example of the correction clock generation circuit 40 is shown in FIG. 26 and the operational timing diagram is shown in FIG. 27. In this example, the correction clock is the Q output of a RS flip-flop which is set by the horizontal synchronization signal 8 and reset by the data latch clock 7. Note that a correction clock shown in FIG. 28(*a*) can be generated by using the inverted signal of the horizontal synchronization signal as a set input signal. Also, a correction clock shown in FIG. 28(*b*) can be generated by applying a signal in synchronization with the data taking-in completion of one horizontal period to a set input and also the inverted signal of the horizontal synchronization signal to a reset input. Thus, in the circuit of FIG. 26, the generation of the correction clock is possible at various timings.

Now, a second embodiment of the present invention will be described while referring to the accompanying drawings.

The constitution of a liquid crystal drive unit of this embodiment, as with the first embodiment, is shown by FIG. 1. The liquid crystal display unit has a liquid crystal panel 1 for displaying an image, and to the liquid crystal panel 1 there is connected a segment driver 2 which is a segment-side drive unit and a common driver 3 which is a common-side drive unit. To the segment driver 2 and the common driver 3 there is connected a power supply circuit 4 for supplying an electric power and a controller 5 for sending out various kinds of control signals. A display data 6, a data latch clock 7 for taking in data, a horizontal synchronization signal 8, an alternate signal 9, and a correction clock 17 for determining a correction period are input to the segment driver 2 from the controller 5. The horizontal synchronization signal 8 and a vertical synchronization signal 10 for recognizing the leading head of a 1 screen are input to the common driver 3 from the controller 5. Note that reference numerals 11 to 16 are liquid crystal drive power supply voltages.

Figure 9:
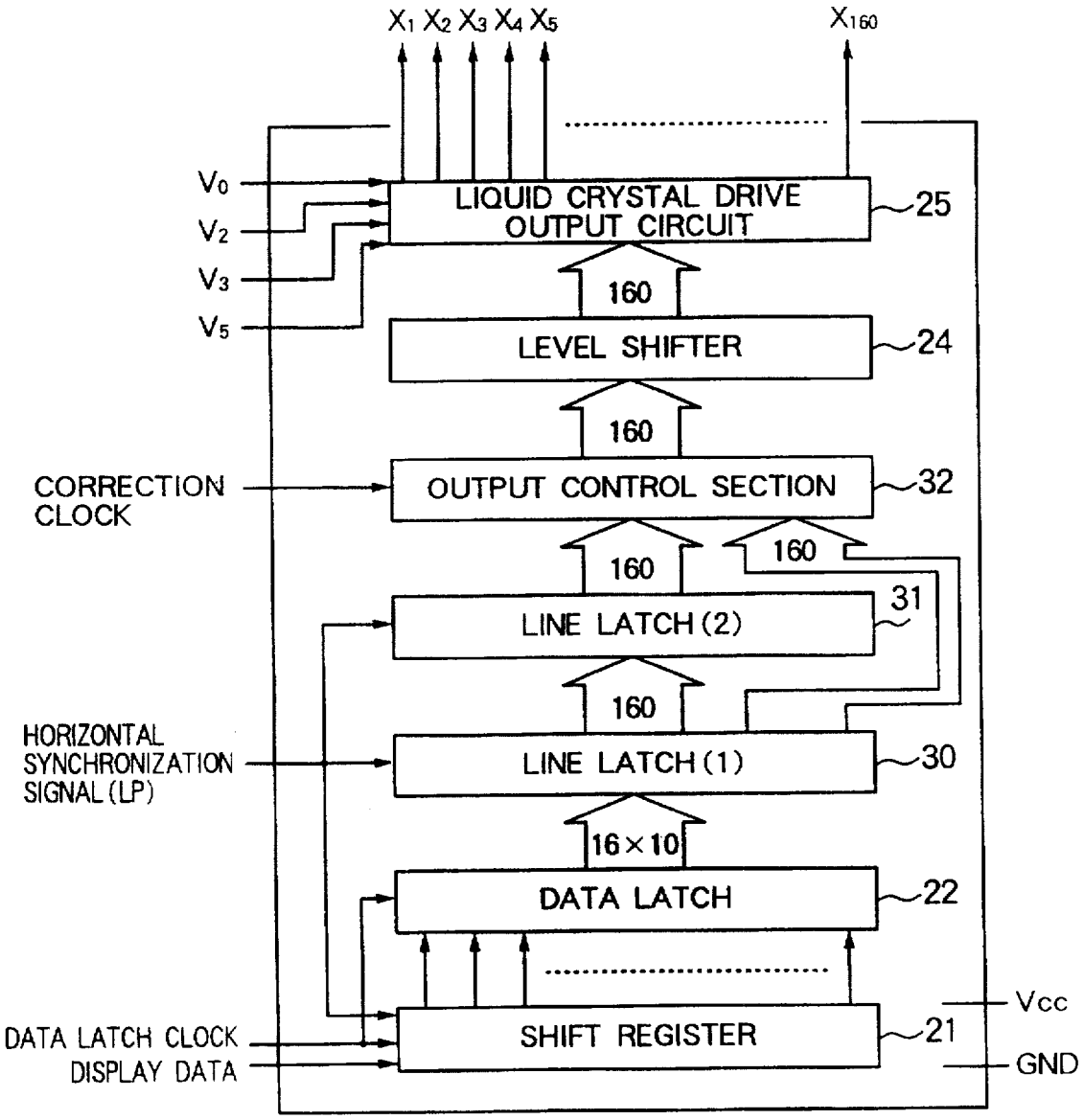
FIG. 9 illustrates the constitution of the segment driver of the liquid crystal drive unit of the present invention.

An example of the segment driver 2 is constituted by a shift register 21, a data latch circuit 22, two line latch circuits 30 and 31, an output control section 32 serving as a voltage control means, a level shifter 24, and a liquid crystal drive output circuit 25, as shown in FIG. 9.

The segment driver of FIG. 9 is provided with a data latch for latching data of a previous line and has the output control section 32 where the data of the present line is compared with the data of the previous line and, only when these data are the same, the display data is inverted by the correction clock.

Figure 10:
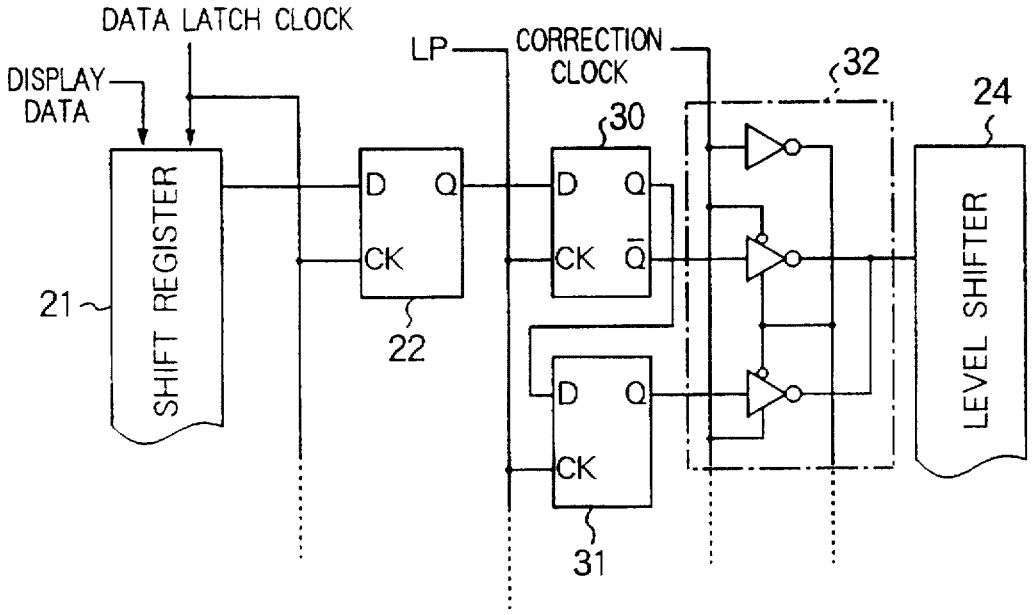
FIG. 10 illustrates the constitution of an output control section of the segment driver of the liquid crystal drive unit of the present invention.
Figure 14:
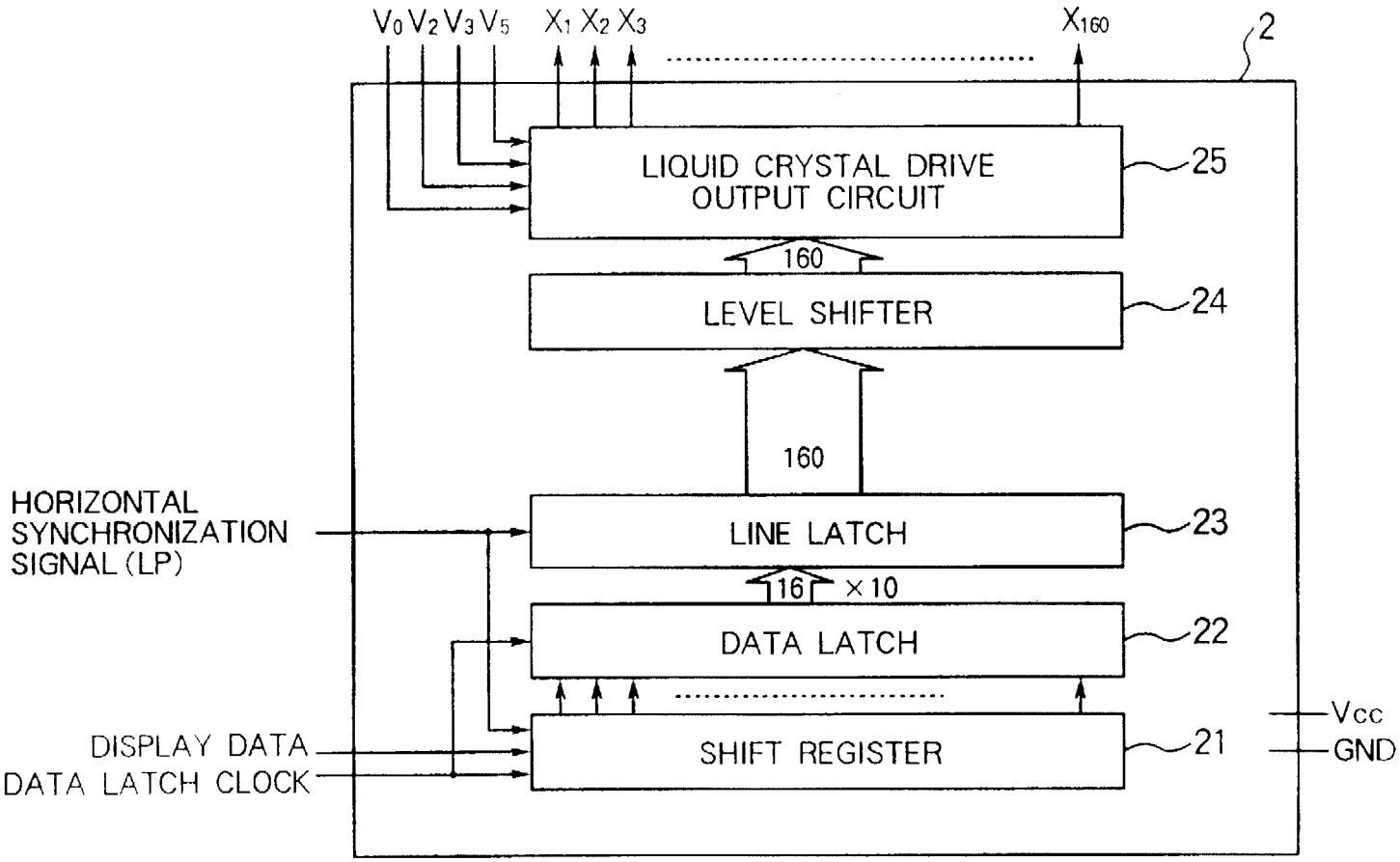
FIG. 14 illustrates the constitution of the segment driver of the conventional liquid crystal drive unit.
Figure 15:
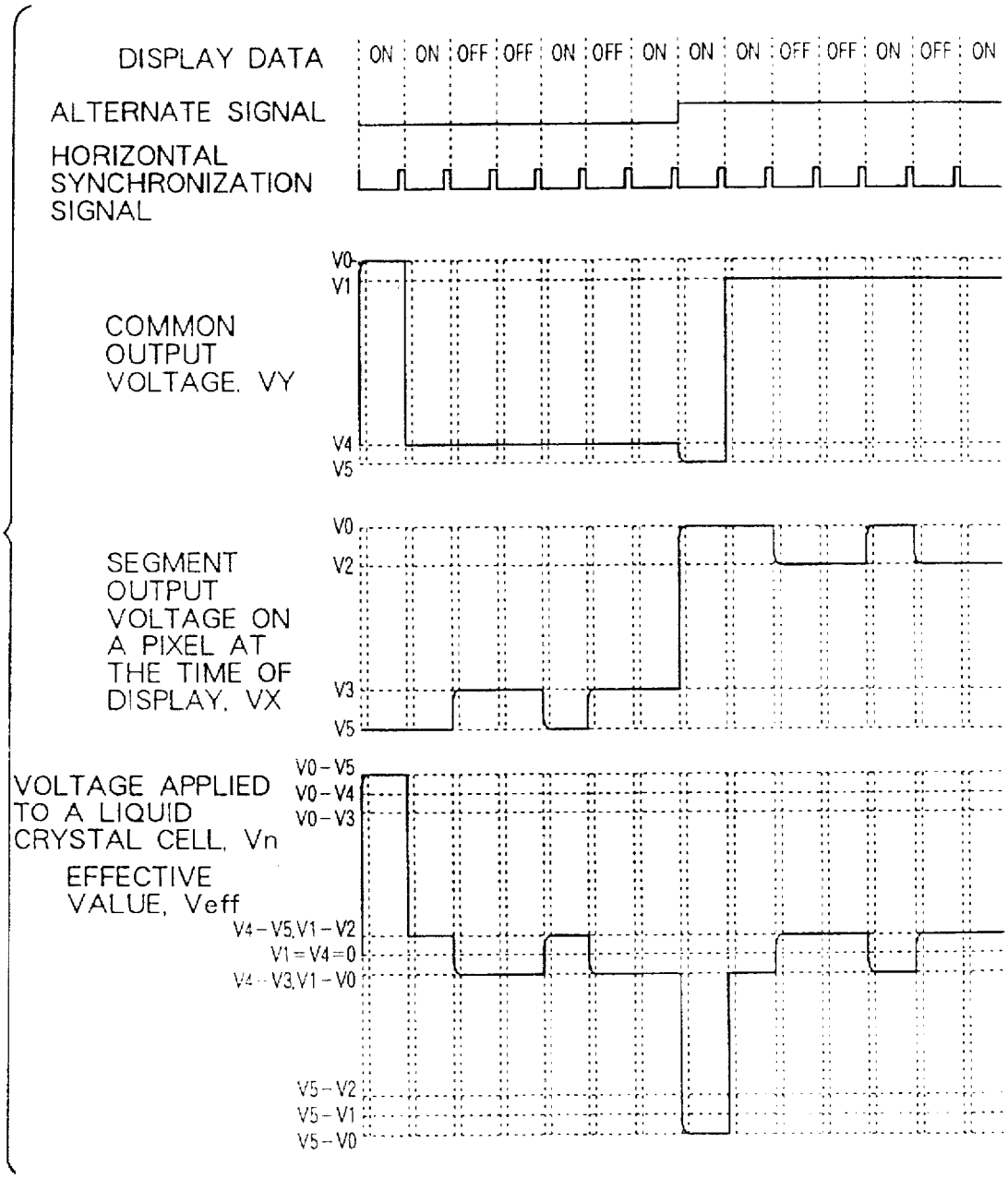
FIG. 15 illustrates the timing of a conventional liquid crystal display unit.
Figure 16:
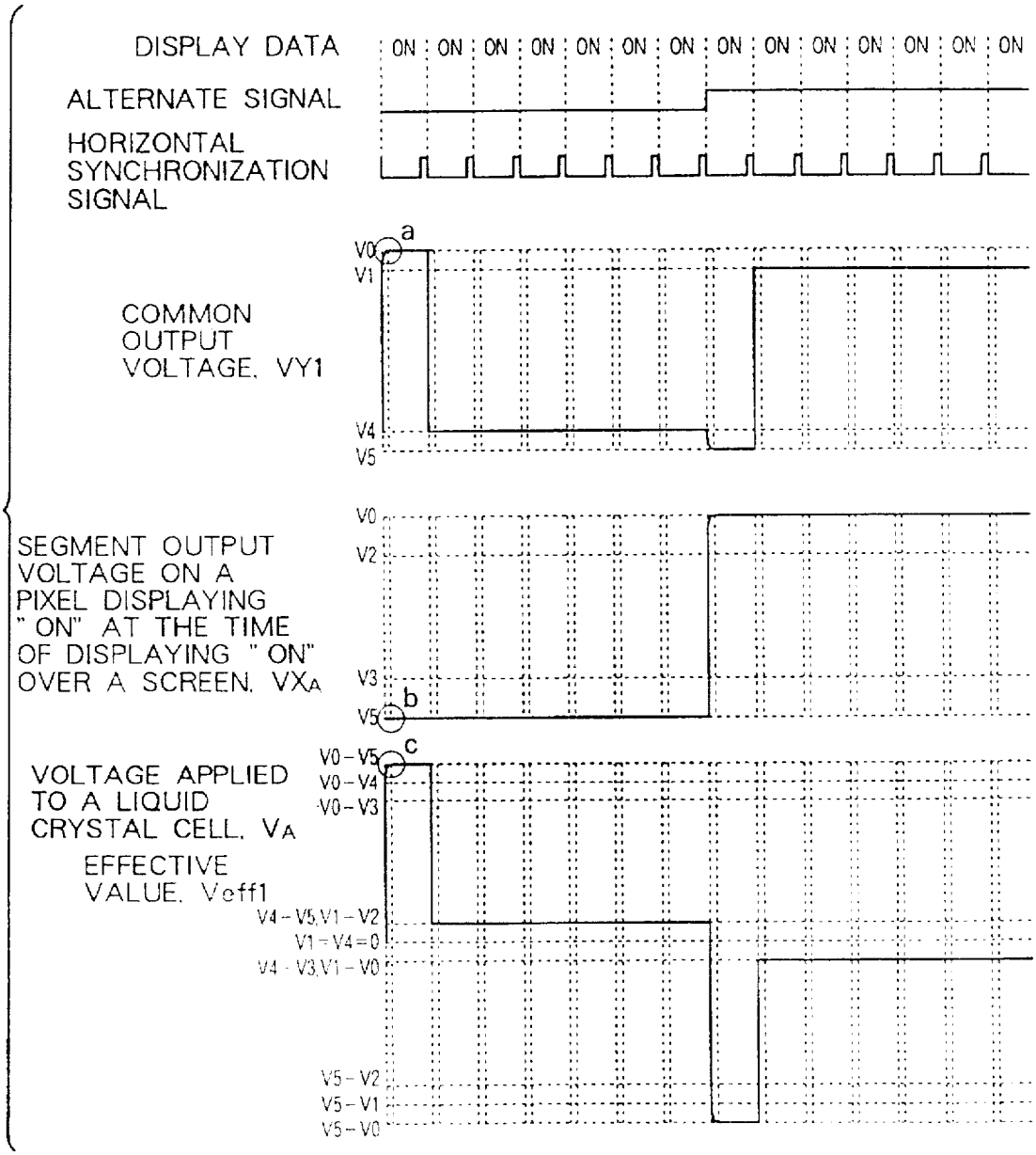
FIG. 16 illustrates the output waveform of each driver of the conventional liquid crystal display unit and also the applied voltage waveform that is applied to the liquid crystal cell.
Figure 17:
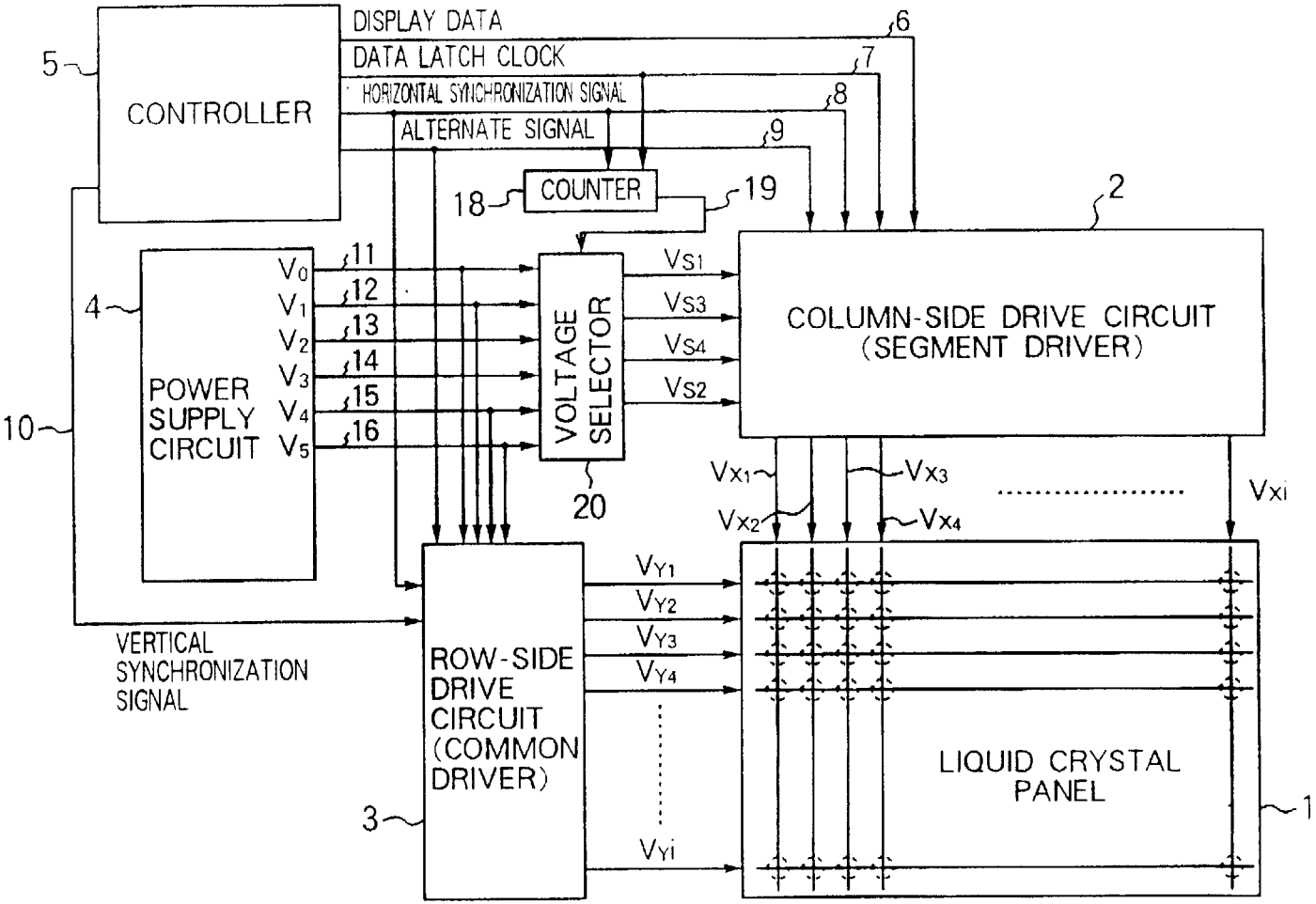
FIG. 17 illustrates the constitution of the conventional liquid crystal display unit.
Figure 18:
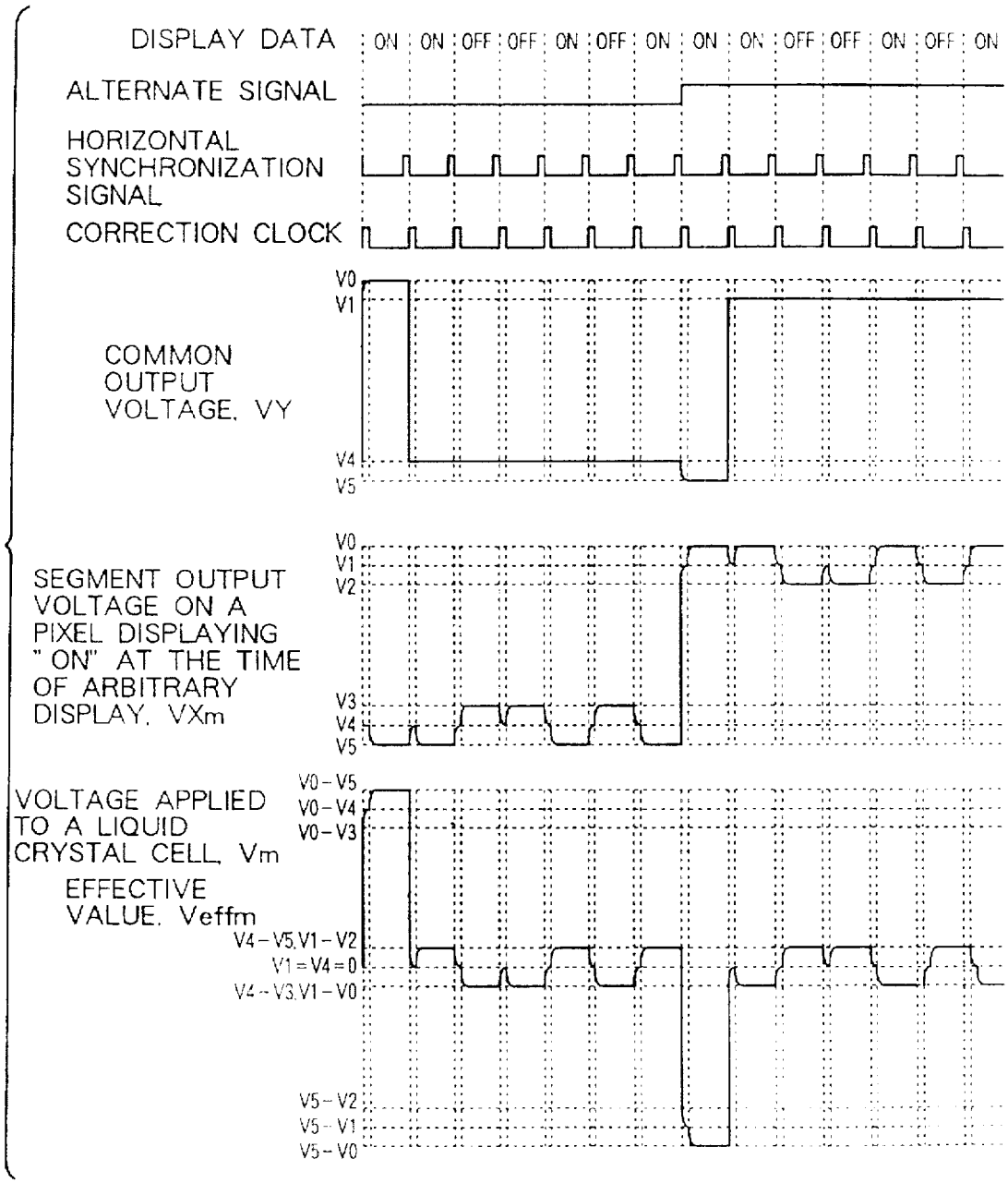
FIG. 18 illustrates the timing of the conventional liquid crystal display unit.
Figure 19:
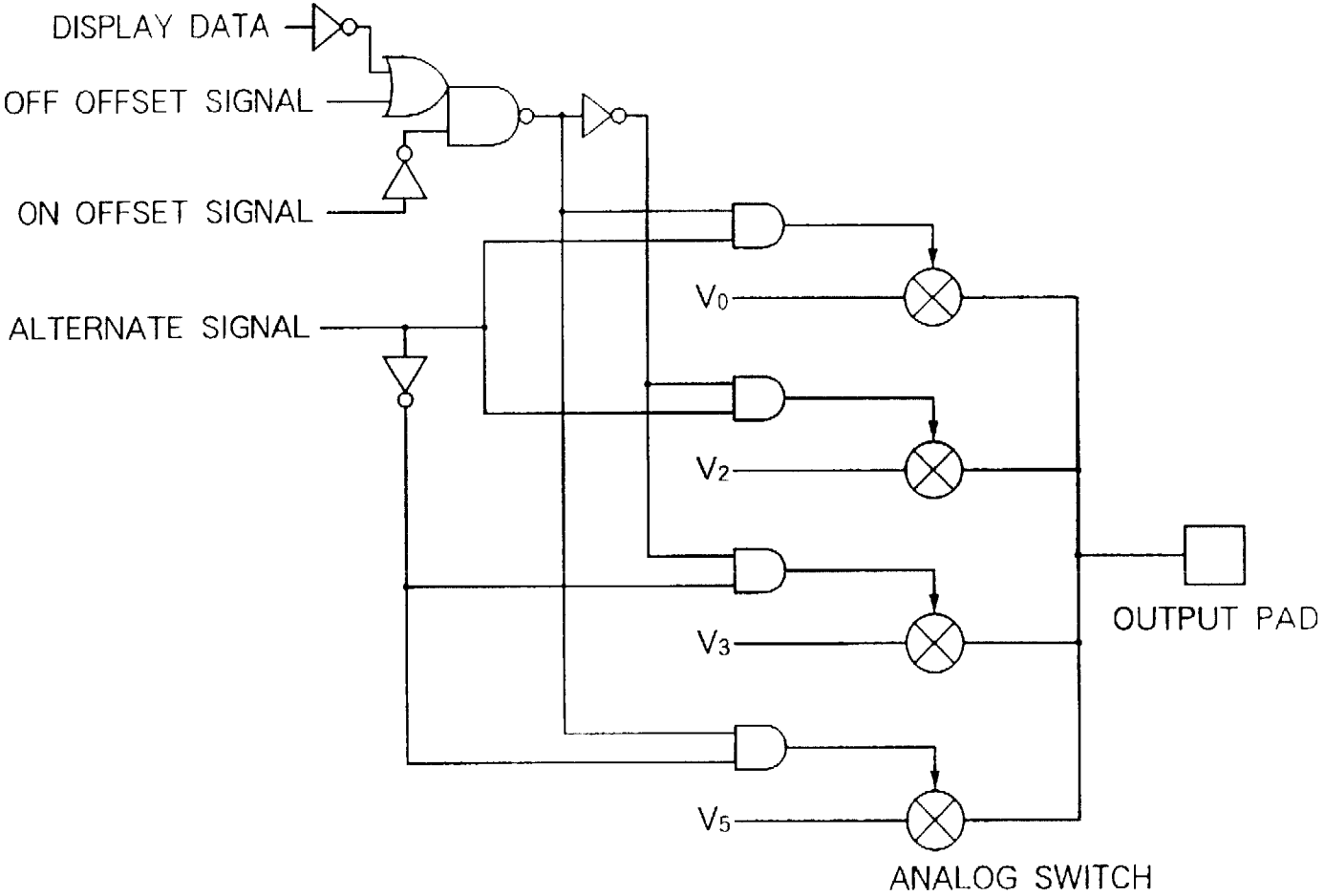
FIG. 19 illustrates the constitution of the segment driver of the conventional liquid crystal display unit.
Figure 20:
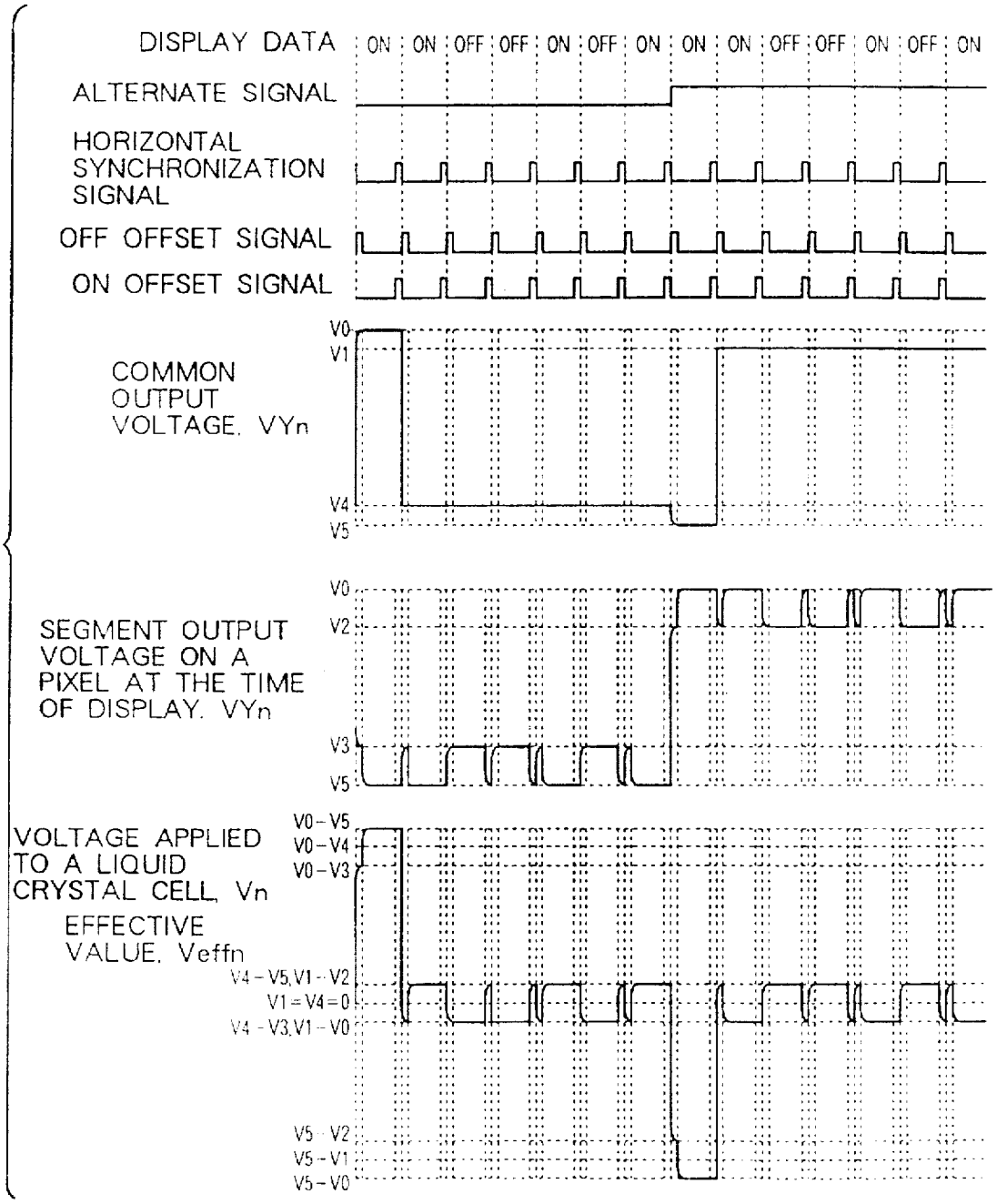
FIG. 20 illustrates the timing section of the conventional liquid crystal display unit.

FIG. 10 illustrates an example of a circuit diagram of part of an internal circuit corresponding to a 1 output in FIG. 9. The segment driver of FIG. 10, while the conventional segment driver latches and outputs data of a line (by a line latch 23 of FIG. 14), is provided with a line latch (2) 31 for latching data of a previous line in addition to a line latch (1) 30 for latching data of the present line. The segment driver is constructed so that it has the output control section 32 where the data of the present line is compared with the data of the previous line and, only when these data are the same, the display data is inverted by the correction clock.

Figure 11:
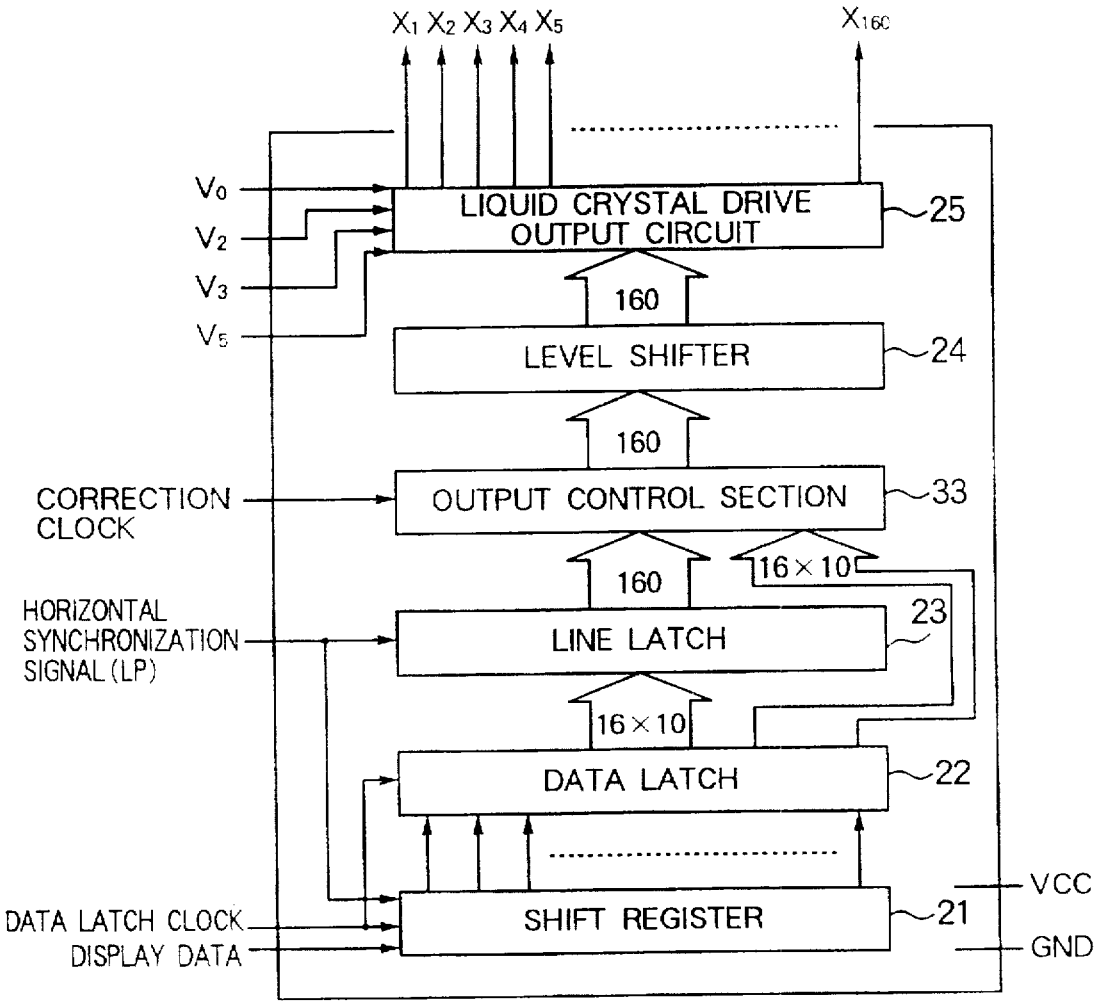
FIG. 11 illustrates the constitution of the segment driver of the liquid crystal drive unit of the present invention.

Another example of the segment driver 2 is constituted by a shift register 21, a data latch circuit 22, a line latch circuit 23, an output control section 33 serving as a voltage control means, a level shifter 24, and a liquid crystal drive output circuit 25, as shown in FIG. 11.

The segment driver of FIG. 11 is constructed so that it has the output control section 33 where the data of the present line is compared with the data of the next line and, only when these data are the same, the display data is inverted by the correction clock.

Figure 12:
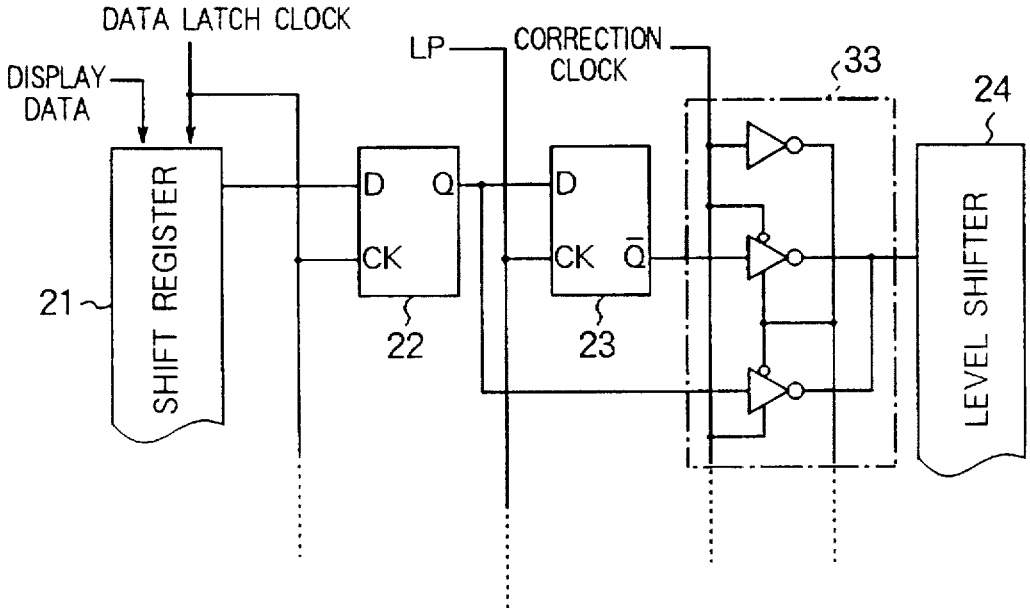
FIG. 12 illustrates the constitution of an output control section of the segment driver of the liquid crystal drive unit of the present invention.
Figure 13:
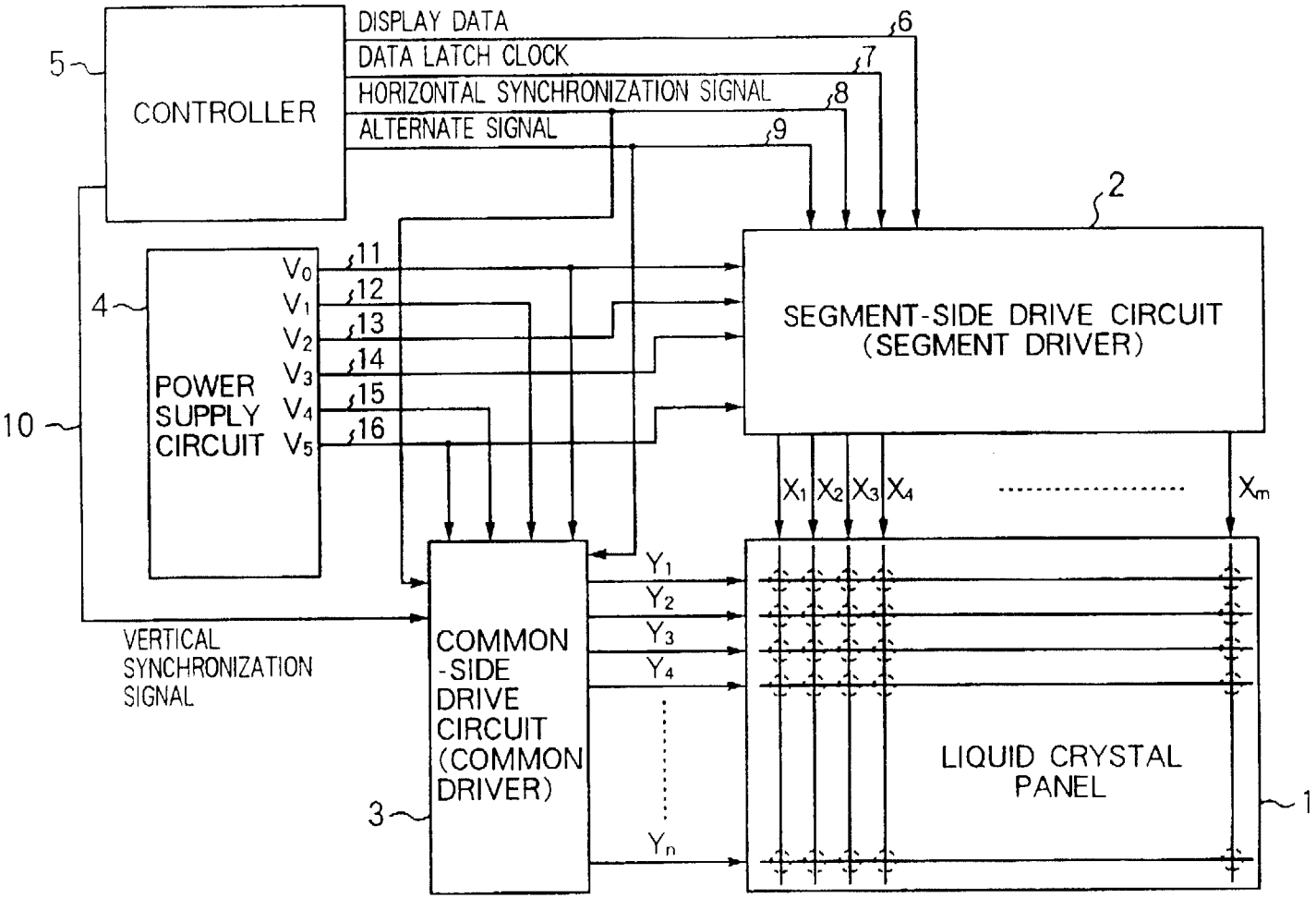
FIG. 13 illustrates the constitution of a conventional liquid crystal display unit.

FIG. 12 illustrates an example of a circuit diagram of part of an internal circuit corresponding to a 1 output in FIG. 11. The segment driver of FIG. 12 is constructed so that it has the output control section 33 which compares an output of a line latch 23 which is the data of the present line with an output of a line latch 22 which is the data of the next line and where, only when these data are the same, the display data is inverted by the correction clock.

Now, the operation of this embodiment will be described along timing charts of FIGS. 7 and 8 and FIGS. 32 to 34.

Figure 8:
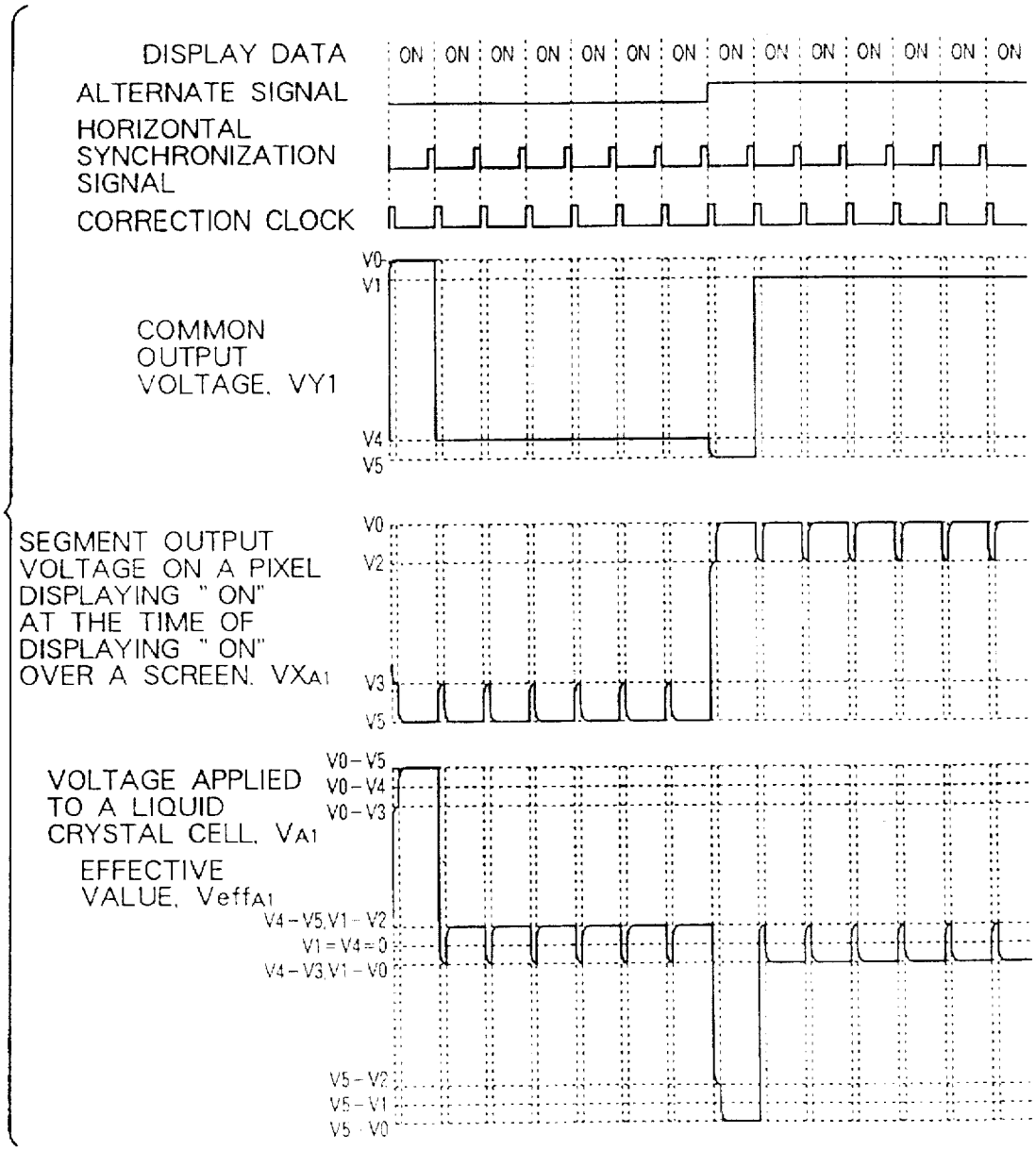
FIG. 8 illustrates the output waveform of each driver of the liquid crystal display unit of the present invention and also the applied voltage waveform that is applied to the liquid crystal cell.
Figure 32:
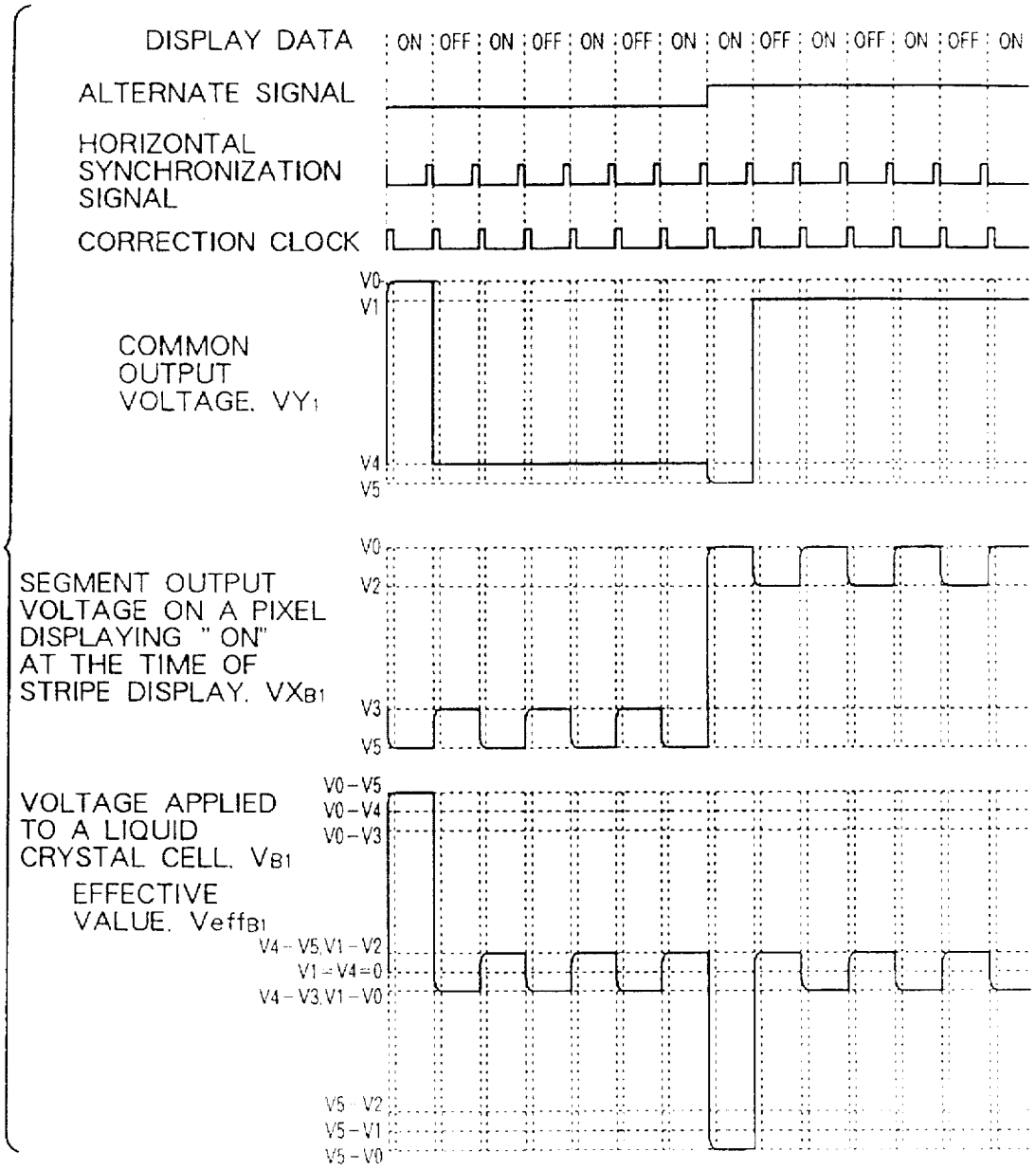
FIG. 32 illustrates the output waveform of each driver of the liquid crystal display unit of the present invention and also the applied voltage waveform that is applied to the liquid crystal cell.
Figure 33:
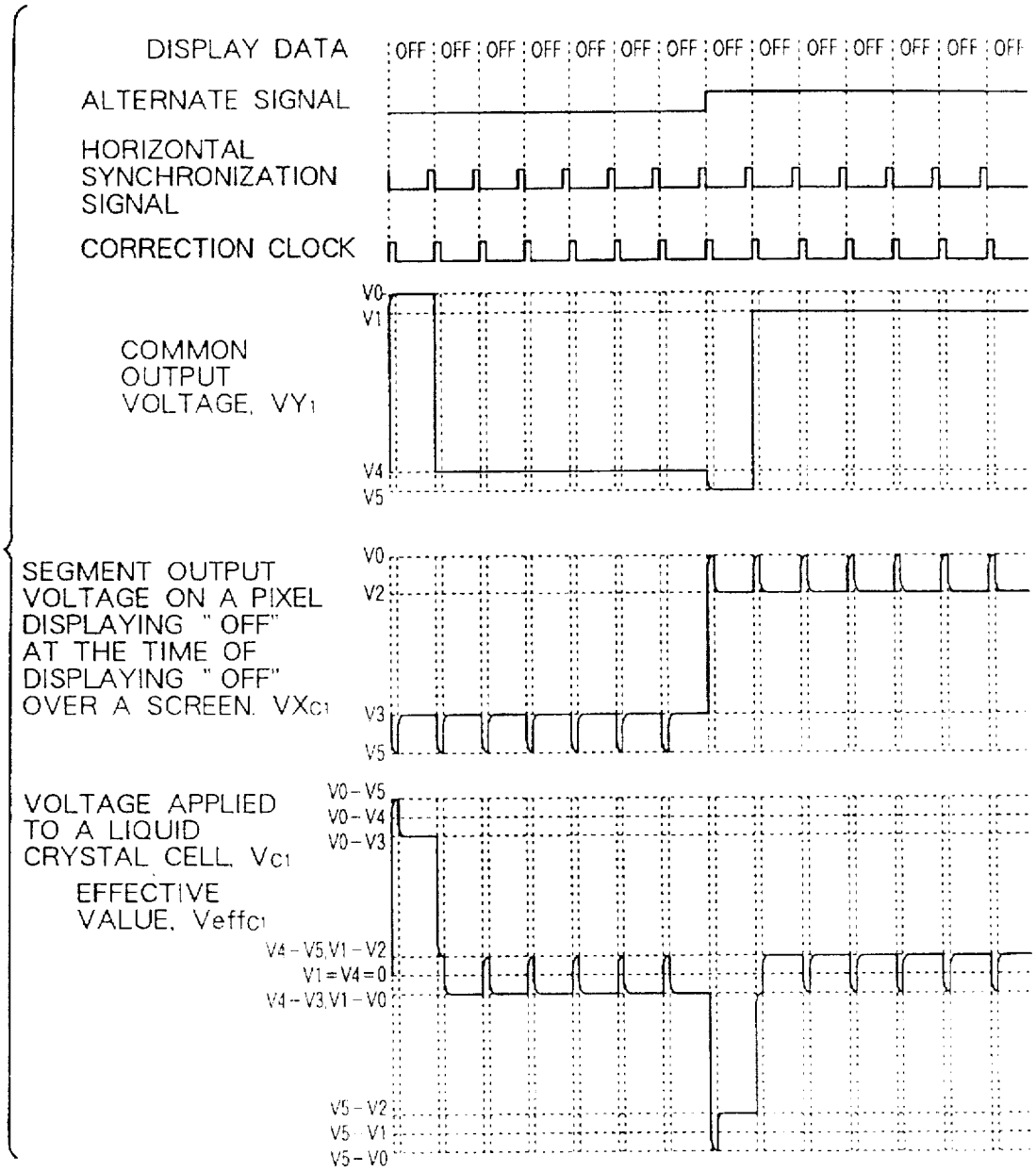
FIG. 33 illustrates the output waveform of each driver of the liquid crystal display unit of the present invention and also the applied voltage waveform that is applied to the liquid crystal cell.
Figure 34:
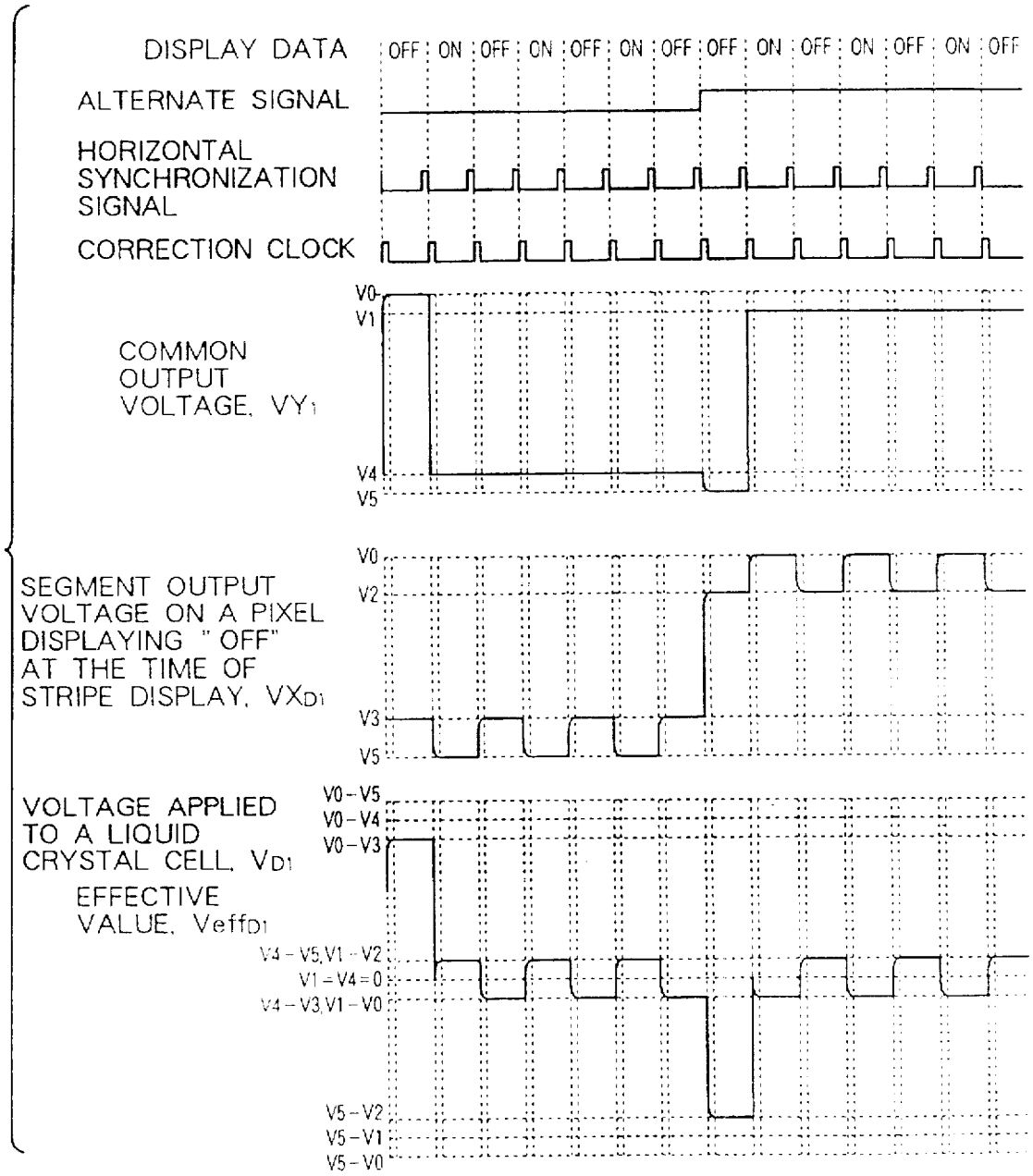
FIG. 34 illustrates the output waveform of each driver of the liquid crystal display unit of the present invention and also the applied voltage waveform that is applied to the liquid crystal cell.
Figure 35:
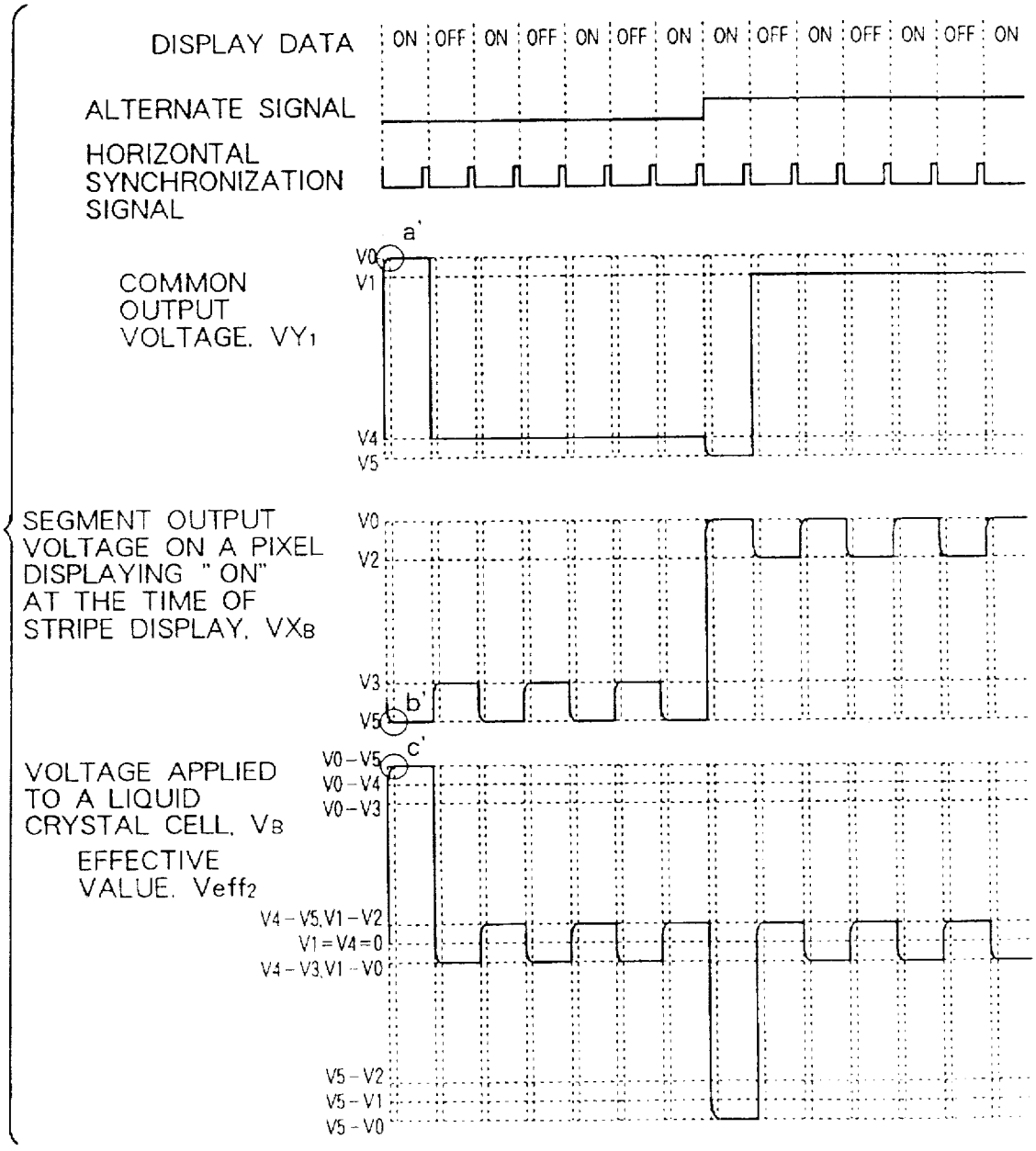
FIG. 35 illustrates the output waveform of each driver of the conventional liquid crystal display unit and also the applied voltage waveform that is applied to the liquid crystal cell.
Figure 36:
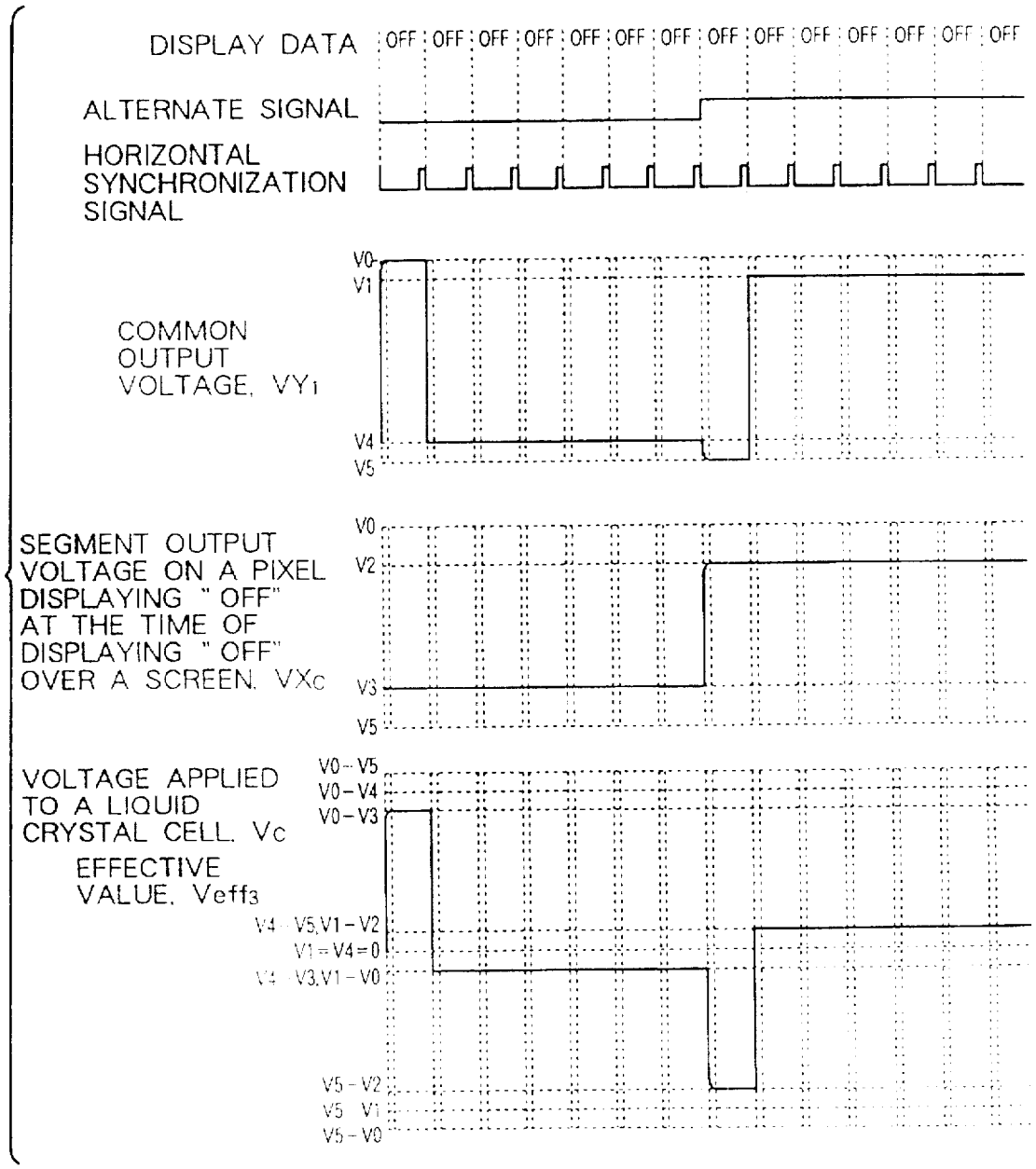
FIG. 36 illustrates the output waveform of each driver of the conventional liquid crystal display unit and also the applied voltage waveform that is applied to the liquid crystal cell.
Figure 37:
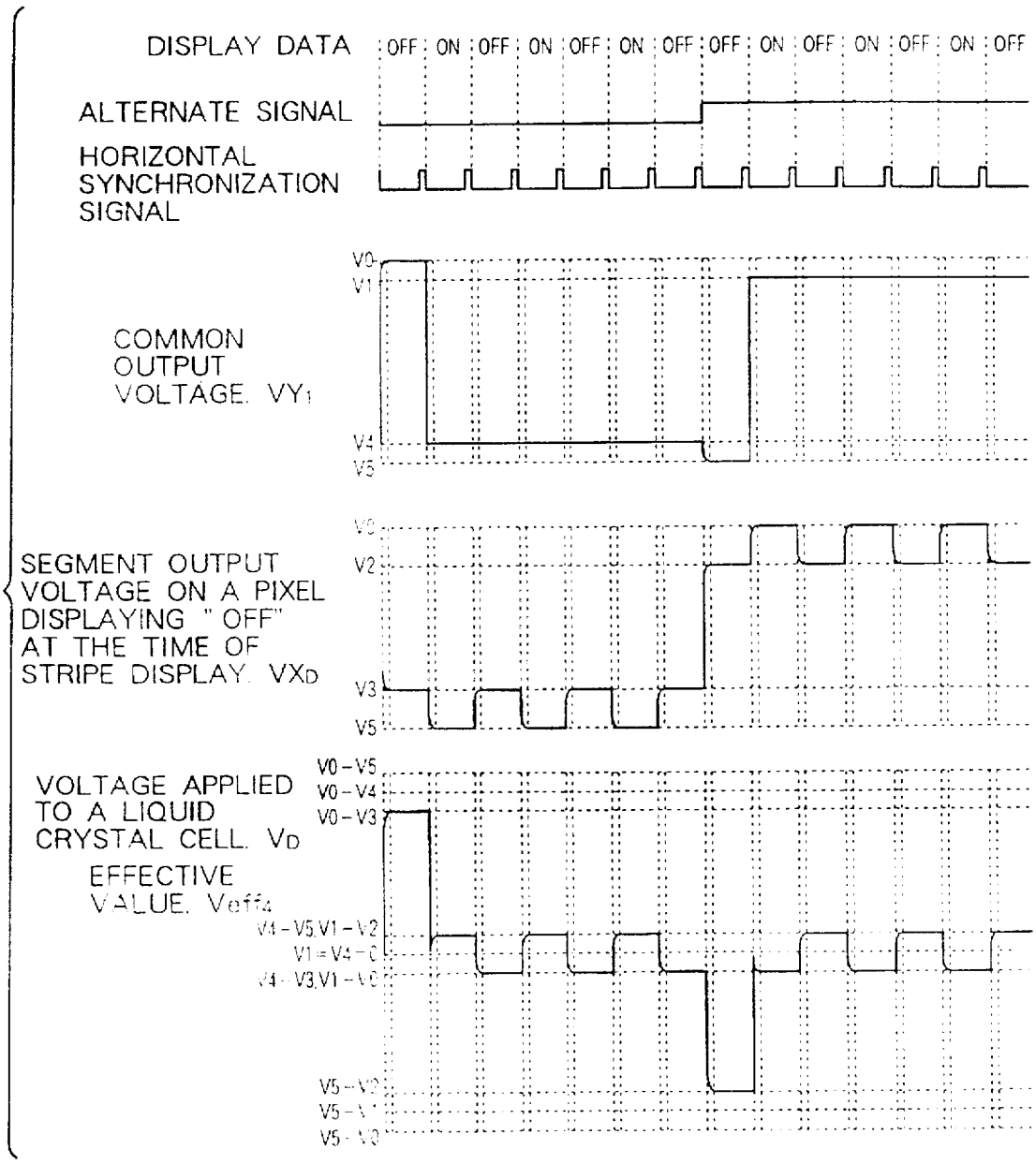
FIG. 37 illustrates the output waveform of each driver of the conventional liquid crystal display unit and also the applied voltage waveform that is applied to the liquid crystal cell.

The display data 6 for the 1 scan of an electrode and the data latch clock 7 for the 1 scan of an electrode are added to the segment driver 2 so that the display data 6 are shifted and input for display. If the display data 6 for the 1 scan of an electrode are accumulated, then the horizontal synchronization signal 8 will be added and the accumulated display data 6 will be loaded to the output side of the segment driver 2. According to a combination of the loaded display data 6 and the alternate signal 9, any one level voltage of the liquid crystal drive power supply voltages $V_0$ voltage 11, $V_2$ voltage 13, $V_3$ voltage 14, and $V_5$ voltage 16 of four levels is selected with respect to each data electrode, and the outputs of the segment driver for the 1 scan of an electrode are applied to the segment-side electrode in a parallel manner. At this time, if the correction clock 17 which is generated by the controller 5 is added to the segment driver 2, then the display data 6, loaded during the period of the correction clock, will be inverted. And, according to a combination of the inverted display data 6 and the alternate signal 9, any one level voltage of the liquid crystal drive power supply voltages $V_0$ voltage 11, $V_2$ voltage 13, $V_3$ voltage 14, and $V_5$ voltage 16 of four levels is selected. FIG. 8 illustrates the output waveform of each driver in the case of the ON display over the entire screen and also a voltage waveform which is applied to a liquid crystal cell, and FIG. 32 illustrates the output waveform of each driver in the case of the ON display of the case of the stripe display and also a voltage waveform which is applied to a liquid crystal cell. FIG. 33 illustrates the output waveform of each driver in the case of the OFF display over the entire screen and also a voltage waveform which is applied to a liquid crystal cell. FIG. 34 illustrates the output waveform of each driver in the case of the OFF display of the case of the stripe display and also a voltage waveform which is applied to a liquid crystal cell. In FIG. 8 and FIGS. 32 to 34, the effective voltages of FIGS. 8 and 32 and of FIGS. 33 and 34 become equal to each other by controlling the pulse width of the correction clock so that it becomes equal to the reduction amount of the effective voltage caused by the waveform dull, and consequently, the shadowing that is caused by a difference in the display data is reduced.

From FIG. 10 or FIG. 12, the display data being presently output with respect to the conventional segment driver is compared with the display data of the previous line or the display data of the next line, and only when the display data are the same data, the display data can be inverted by the correction clock. Therefore, an inexpensive liquid crystal display unit can be realized because a new voltage selector is not needed. Also, the data of the previous line is compared with the data of the present line or the data of the next line, and only when the display data are the same data, the display data is inverted by the correction clock. Therefore, a liquid crystal display unit which suppresses consumption current can be realized because the correction period can be suppressed to the minimum.

Furthermore, the correction clock is not only a method of generating the clock from the controller but also it can be internally generated by providing a counter in the interior of the segment driver. In such a case, with the constitution of the conventional liquid crystal display system, the correction period is provided in the output of the segment-side liquid crystal drive unit once at intervals of a 1-line scanning period, and for the liquid crystal drive output level, the display voltage level can be inverted during the correction period (the display voltage level can be inverted to the OFF display voltage level when the display voltage level is in the ON display voltage level and to the ON display voltage level when the display voltage level is in the OFF display voltage level).

Even in the aforementioned second embodiment, a correction clock generation circuit such as that shown in FIG. 24 or FIG. 26 can be incorporated in the segment driver 2, and with this, similar advantages are obtainable.

Many widely different embodiments of the present invention may be constructed without departing from the spirit and scope of the present invention. It should be understood that the present invention is not limited to the specific embodiments described in the specification, except as defined in the appended claims.

What is claimed is:

1. A drive method for a simple matrix liquid crystal display unit which performs a liquid crystal display by controlling segment-side liquid crystal drive means and common-side liquid crystal drive means by a controller, wherein:

an output correction period is provided in an output of said segment-side liquid crystal drive means at intervals of a 1-line scanning period, and during said output correction period a display voltage level of said output is set to an OFF display voltage level when said display voltage level of said output is in an ON display level and to an ON display voltage level when said display voltage level of said output is in an OFF display level.

2. A drive method for a simple matrix liquid crystal display unit which performs a liquid crystal display by controlling segment-side liquid crystal drive means and common-side liquid crystal drive means by a controller, wherein:

an output correction period is provided in an output of said segment-side liquid crystal drive means at intervals of a 1-line scanning period;

outputs of two successive scans are compared; and if said outputs of two successive scans are the same, during said output correction period a display voltage level of said output is set to an OFF display voltage level when said display voltage level of said output is in an ON display level and to an ON display voltage level when said display voltage level of said output is in an OFF display level.

3. A drive unit for a simple matrix liquid crystal display unit which includes segment-side liquid crystal drive means, common-side liquid crystal drive means, and a controller for controlling said two means, wherein:

said controller or said segment-side liquid crystal drive means includes correction clock means for generating a correction clock prescribing a correction period of an output of said segment-side drive means; and said segment-side liquid crystal drive means includes an output control means which, at intervals of a 1-line scanning period, detects said correction clock to provide an output correction period and which, during said output correction period, sets a display voltage level of said output to an OFF display voltage level when said display voltage level of said output is in an ON display level and to an ON display voltage level when said display voltage level of said output is in an OFF display level.

4. The drive unit for a liquid crystal display unit, as set forth in claim 3, wherein said output control means is constituted by a clock gate or a selector.

5. A drive unit for a simple matrix liquid crystal display unit which includes segment-side liquid crystal drive means, common-side liquid crystal drive means, and a controller for controlling said two means, wherein:

said segment-side liquid crystal drive means includes correction clock means for generating a correction clock prescribing a correction period of an output of said segment-side drive means;

said correction clock means generates said correction clock, based on a horizontal synchronization signal and a data latch clock which are input by said controller; and said segment-side liquid crystal drive means includes an output control means which, at intervals of a 1-line scanning period, detects said correction clock to provide an output correction period and which, during said output correction period, sets a display voltage level of said output to an OFF display voltage level when said display voltage level of said output is in an ON display level and to an ON display voltage level when said display voltage level of said output is in an OFF display level.

6. The drive unit for a liquid crystal display unit, as set forth in claim 5, wherein said output control means is constituted by a clock gate or a selector.

7. A drive unit for a simple matrix liquid crystal display unit which includes segment-side liquid crystal drive means, common-side liquid crystal drive means, and a controller for controlling said two means, wherein:

said controller or said segment-side liquid crystal drive means includes correction clock means for generating a correction clock prescribing a correction period of an output of said segment-side drive means; and said segment-side liquid crystal drive means includes an output control means which, at intervals of a 1-line scanning period, detects said correction clock to provide an output correction period and which compares outputs of two successive scans and, if said outputs of two successive scans are the same, sets during said output correction period a display voltage level of said output to an OFF display voltage level when said display voltage level of said output is in an ON display level and to an ON display voltage level when said display voltage level of said output is in an OFF display level.

8. A drive unit for a simple matrix liquid crystal display unit which includes segment-side liquid crystal drive means, common-side liquid crystal drive means, and a controller for controlling said two means, wherein:

said segment-side liquid crystal drive means includes correction clock means for generating a correction clock prescribing a correction period of an output of said segment-side drive means;

said correction clock means generates said correction clock, based on a horizontal synchronization signal and a data latch clock which are input by said controller; and said segment-side liquid crystal drive means includes an output control means which, at intervals of a 1-line scanning period, detects said correction clock to provide an output correction period and which compares outputs of two successive scans and, if said outputs of two successive scans are the same, sets during said output correction period a display voltage level of said output to an OFF display voltage level when said display voltage level of said output is in an ON display level and to an ON display voltage level when said display voltage level of said output is in an OFF display level.

* * * * *